US012207699B2

(12) United States Patent
Dekovic et al.

(10) Patent No.: US 12,207,699 B2
(45) **Date of Patent: *Jan. 28, 2025**

(54) FOOTWEAR SOLE STRUCTURE INCORPORATING A PLURALITY OF CHAMBERS

(71) Applicant: NIKE, Inc., Beaverton, OR (US)

(72) Inventors: Denis Dekovic, Portland, OR (US); Bradley S. Long, Portland, OR (US); Brian E. Santa Maria, Portland, OR (US); Benjamin A. Shaffer, Saratoga, CA (US); Danielle L. Taylor, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 263 days.

This patent is subject to a terminal disclaimer.

(21) Appl. No.: 15/987,060

(22) Filed: May 23, 2018

(65) Prior Publication Data

US 2018/0263336 A1 Sep. 20, 2018

Related U.S. Application Data

(63) Continuation of application No. 13/049,245, filed on Mar. 16, 2011, now Pat. No. 10,010,136.

(51) Int. Cl.
*A43B 13/20* (2006.01)
*A43B 7/1445* (2022.01)
(Continued)

(52) U.S. Cl.
CPC ..... *A43B 13/20* (2013.01); *A43B 7/1445* (2013.01); *A43B 7/148* (2013.01); *A43B 13/141* (2013.01); *A43B 13/184* (2013.01)

(58) Field of Classification Search
CPC ..... A43B 13/20; A43B 7/1445
(Continued)

(56) References Cited

U.S. PATENT DOCUMENTS 4,183,156 A 1/1980 Rudy
4,219,945 A 9/1980 Rudy
(Continued)

FOREIGN PATENT DOCUMENTS

CN 1867273 A 11/2006
CN 101516223 A 8/2009
(Continued)

OTHER PUBLICATIONS

European Patent Office, Communication pursuant to Article 94(3) EPC for EP Application No. 12716799.7, mailed Mar. 8, 2016.
(Continued)

*Primary Examiner* — Alissa J Tompkins
*Assistant Examiner* — Catherine M Ferreira
(74) *Attorney, Agent, or Firm* — Honigman LLP; Matthew H. Szalach; Jonathan P. O'Brien

(57) ABSTRACT

A plurality of fluid-filled chambers may be incorporated into sole structures of articles of footwear. The chambers may be configured to be substantially diamond-shaped. The chambers may lie within cavities formed by a lower surface of the midsole and may extend into apertures in the outsole. The apertures in the outsole may be aligned with the cavities of the midsole. The chambers may be bounded by bounding regions between and at the perimeter of the chambers. The bounding regions may be formed of a polymer foam material of the midsole. The chambers may additionally be connected.

17 Claims, 34 Drawing Sheets

(51) Int. Cl.
*A43B 7/148* (2022.01)
*A43B 13/14* (2006.01)
*A43B 13/18* (2006.01)

(58) Field of Classification Search
USPC ..... 36/103
See application file for complete search history.

(56) References Cited

U.S. PATENT DOCUMENTS

| | | | | |
|---|---|---|---|---|
| 4,340,626 | A | 7/1982 | Rudy | |
| 4,936,029 | A | 6/1990 | Rudy | |
| 5,042,176 | A | 8/1991 | Rudy | |
| 5,367,791 | A | 11/1994 | Gross et al. | |
| 5,713,141 | A | 2/1998 | Mitchell et al. | |
| 5,952,065 | A | 9/1999 | Mitchell et al. | |
| 6,009,637 | A * | 1/2000 | Pavone | A43B 13/187 36/28 |
| 6,013,340 | A | 1/2000 | Bonk et al. | |
| 6,023,859 | A | 2/2000 | Burke et al. | |
| 6,082,025 | A | 7/2000 | Bonk et al. | |
| 6,127,026 | A | 10/2000 | Bonk et al. | |
| 6,203,868 | B1 | 3/2001 | Bonk et al. | |
| 6,321,465 | B1 | 11/2001 | Bonk et al. | |
| 6,845,573 | B2 | 1/2005 | Litchfield et al. | |
| 7,000,334 | B2 | 2/2006 | Gillespie | |
| 7,131,218 | B2 | 11/2006 | Schindler | |
| 7,444,763 | B2 | 11/2008 | Grove et al. | |
| 7,588,654 | B2 | 9/2009 | Schindler et al. | |
| 7,591,919 | B2 | 9/2009 | Schindler et al. | |
| 7,752,772 | B2 | 7/2010 | Hatfield et al. | |
| 7,797,856 | B2 | 9/2010 | Andrews et al. | |
| 7,950,169 | B2 | 5/2011 | Holt et al. | |
| 8,146,272 | B2 | 4/2012 | Dukovic et al. | |
| D677,453 | S | 3/2013 | Sakai | |
| D686,406 | S | 7/2013 | Spring | |
| 2004/0148803 | A1 * | 8/2004 | Grove | A43B 7/14 36/103 |
| 2005/0011085 | A1 | 1/2005 | Swigart et al. | |
| 2005/0115107 | A1 | 6/2005 | Schumacher | |
| 2006/0213088 | A1 | 9/2006 | Grove et al. | |
| 2008/0201982 | A1 * | 8/2008 | Aveni | A43B 13/223 36/35 B |
| 2009/0013558 | A1 | 1/2009 | Hazenberg et al. | |
| 2009/0126230 | A1 * | 5/2009 | McDonald | A43B 3/246 36/103 |
| 2009/0193688 | A1 * | 8/2009 | Goodwin | B29D 35/148 36/35 B |
| 2009/0199430 | A1 | 8/2009 | Montross | |
| 2009/0288312 | A1 | 11/2009 | Dua | |
| 2009/0288313 | A1 | 11/2009 | Rapaport et al. | |
| 2009/0293314 | A1 | 12/2009 | Dekovic et al. | |
| 2010/0251565 | A1 | 10/2010 | Litchfield et al. | |
| 2011/0131831 | A1 | 6/2011 | Peyton et al. | |
| 2011/0131832 | A1 | 6/2011 | Brandt et al. | |
| 2016/0037858 | A1 * | 2/2016 | Foxen | A43B 7/144 36/103 |

FOREIGN PATENT DOCUMENTS

| | | | |
|---|---|---|---|
| CN | 101856161 | A | 10/2010 |
| EP | 0456434 | A2 | 11/1991 |
| GB | 2314251 | A | 12/1997 |

OTHER PUBLICATIONS

European Patent Office, Communication pursuant to Article 94(3) EPC for EP Application No. 12716799.7, mailed Mar. 13, 2017.
State Intellectual Property Office, Chinese Office Action for Application No. 201610243764.2, mailed May 3, 2017.
International Preliminary Report on Patentability, for Application No. PCT/US2012/028094, mailed Sep. 26, 2013.
State Intellectual Property Office (P.R.C.), Office Action for Chinese Application No. 201280013190.X, mailed Apr. 24, 2015.
International Search Report and Written Opinion for Application No. PCT/US2012/028094, mailed Sep. 10, 2012.
State Intellectual Property Office (PRC), Office Action for CN Application No. 201610243764.2, mailed Apr. 3, 2018.
European Patent Office, Extended European Search Report for EP Application No. 18194273.1, mailed Jan. 4, 2019.

* cited by examiner

FOOTWEAR SOLE STRUCTURE INCORPORATING A PLURALITY OF CHAMBERS

BACKGROUND

Articles of footwear generally include two primary elements, an upper and a sole structure. The upper is formed from a variety of material elements (e.g., textiles, foam, leather, and synthetic leather) that are stitched or adhesively bonded together to form a void on the interior of the footwear for comfortably and securely receiving a foot. An ankle opening through the material elements provides access to the void, thereby facilitating entry and removal of the foot from the void. In addition, a lace is utilized to modify the dimensions of the void and secure the foot within the void.

The sole structure is located adjacent to a lower portion of the upper and is generally positioned between the foot and the ground. In many articles of footwear, including athletic footwear, the sole structure generally incorporates an insole, a midsole, and an outsole. The insole, which may be located within the void and adjacent to a lower surface of the void, is a thin compressible member that enhances footwear comfort. The midsole, which may be secured to a lower surface of the upper and extends downward from the upper, forms a middle layer of the sole structure. In addition to attenuating ground reaction forces (i.e., providing cushioning for the foot), the midsole may limit foot motions or impart stability, for example. The outsole, which may be secured to a lower surface of the midsole, forms the ground-contacting portion of the footwear and is usually fashioned from a durable and wear-resistant material that includes texturing to improve traction.

Generally, the midsole is primarily formed from a foamed polymer material, such as polyurethane or ethylvinylacetate, that extends throughout a length and width of the footwear. In some articles of footwear, the midsole may include a variety of additional footwear elements that enhance the comfort or performance of the footwear, including plates, moderators, fluid-filled chambers, lasting elements, or motion control members. In some configurations, any of these additional footwear elements may be located between the midsole and either of the upper and outsole, embedded within the midsole, or encapsulated by the foamed polymer material of the midsole, for example. Although many midsoles are primarily formed from a foamed polymer material, fluid-filled chambers or other non-foam structures may form a majority of some midsole configurations.

Various techniques may be utilized to form fluid-filled chambers for articles of footwear or other products, including a two-film technique, a thermoforming technique, and a blowmolding technique, for example. In the two-film technique, two separate polymer sheets are bonded together at specific locations. The thermoforming technique is similar to the two-film technique in that two polymer sheets are bonded together, but also includes utilizing a heated mold to form or otherwise shape the polymer sheets. In the blowmolding technique, a parison formed from a molten or otherwise softened polymer material is placed within a mold having a cavity with the desired configuration of the chamber. Pressurized air induces the polymer material to conform to surfaces of the cavity. The polymer material then cools and retains the shape of the cavity, thereby forming the chamber.

Following each of the techniques discussed above, the chambers are pressurized. That is, a pressurized fluid is injected into the chambers and then sealed within the chambers. One method of pressurization involves forming inflation conduits in residual portions of the polymer sheets or the parison. In order to pressurize the chambers, the fluid is injected through the inflation conduits, which are then sealed. The residual portions of the polymer sheets or the parison, including the inflation conduits, are then trimmed or otherwise removed to substantially complete manufacture of the chambers.

SUMMARY

Various features of a fluid-filled chamber, which may be incorporated into articles of footwear and other products, are disclosed below. In one configuration, an article of footwear has an upper and a sole structure secured to the upper. The sole structure has a midsole and a plurality of fluid-filled chambers. The midsole has an upper surface and a lower surface. The upper surface is positioned adjacent to the upper, and the lower surface defines a plurality of cavities. The chambers are at least partially located within the cavities, and at least some of the chambers have a diamond shape.

In another configuration, an article of footwear has an upper and a sole structure secured to the upper. The sole structure has a midsole, an outsole, and an array of fluid-filled chambers. The midsole has an upper surface and a lower surface. The upper surface is positioned adjacent to the upper, and the lower surface defines an array of cavities. The outsole is secured to the midsole and forms at least part of a ground-contacting surface of the footwear. The fluid-filled chambers are at least partially located within the cavities, protrude outward from the cavities, and form at least part of a ground-contacting surface of the footwear.

In a further configuration, an article of footwear has an upper and a sole structure secured to the upper. The sole structure has a midsole, an outsole, a plurality of first bounding regions, a plurality of second bounding regions, and a plurality of fluid-filled chambers. The midsole has an upper surface and a lower surface. The upper surface is positioned adjacent to the upper. The midsole defines a plurality of cavities. The outsole is secured to the lower surface of the midsole and forms at least part of a ground-contacting surface of the footwear. Each intersection of the first bounding regions and the second bounding regions includes at least one of an obtuse angle and an acute angle. The chambers are at least partially located within the cavities, are at least partially bounded by the first bounding regions, and are at least partially bounded by the second bounding regions.

The advantages and features of novelty characterizing aspects of the invention are pointed out with particularity in the appended claims. To gain an improved understanding of the advantages and features of novelty, however, reference may be made to the following descriptive matter and accompanying Figures that describe and illustrate various configurations and concepts related to the invention.

FIGURE DESCRIPTIONS

The foregoing Summary and the following Detailed Description will be better understood when read in conjunction with the accompanying Figures.

DETAILED DESCRIPTION

The following discussion and accompanying Figures disclose various configurations of fluid-filled chambers. Although the chambers are disclosed with reference to footwear having a configuration that is suitable for running, concepts associated with the chambers may be applied to a wide range of athletic footwear styles, including basketball shoes, cross-training shoes, football shoes, golf shoes, hiking shoes and boots, ski and snowboarding boots, soccer shoes, tennis shoes, and walking shoes, for example. Concepts associated with the chambers may also be utilized with footwear styles that are generally considered to be non-athletic, including dress shoes, loafers, and sandals.

General Footwear Structure

Figure 1:
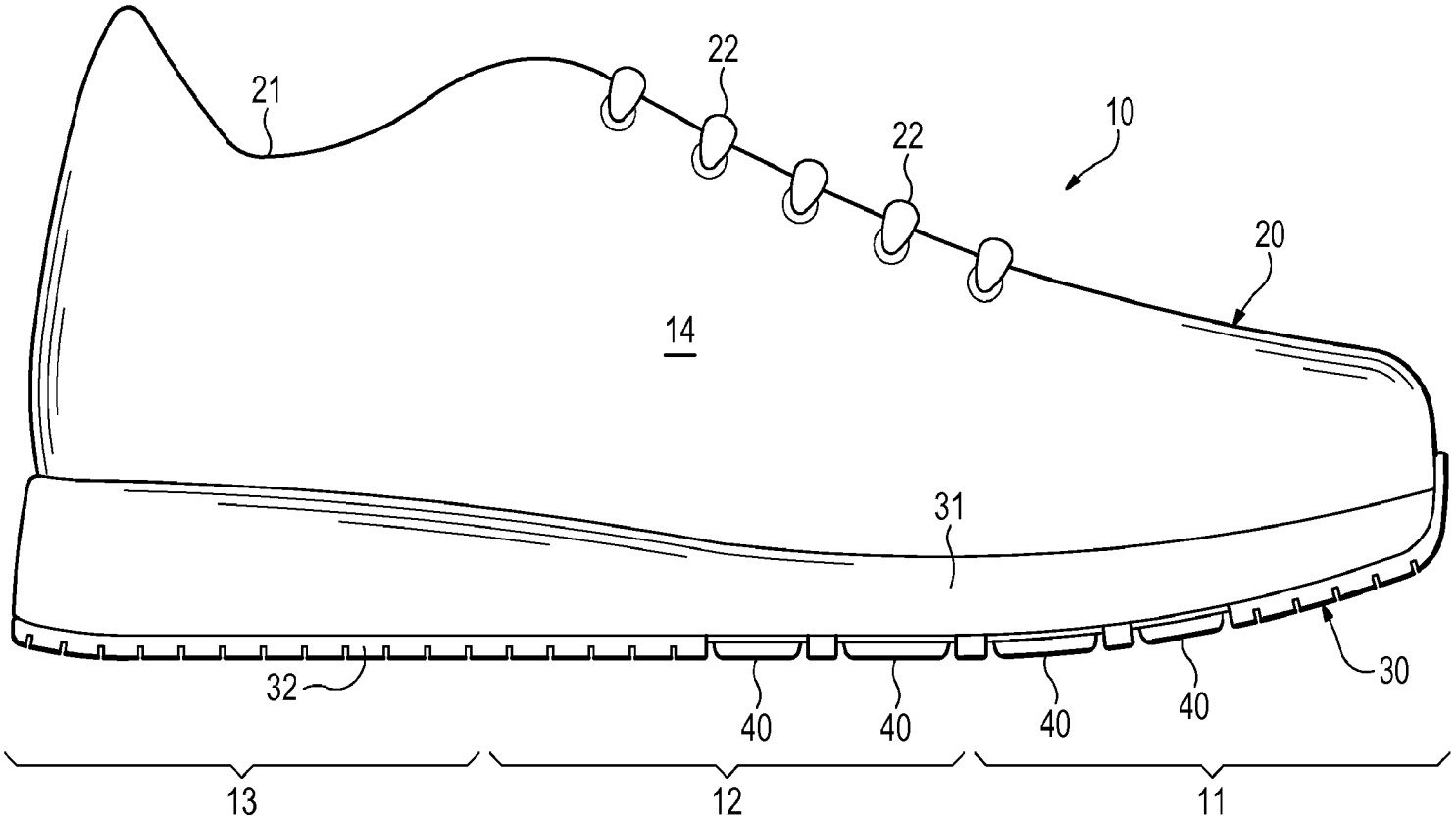
FIG. 1 is a lateral side elevational view of an article of footwear incorporating a plurality of fluid-filled chambers.
Figure 2:
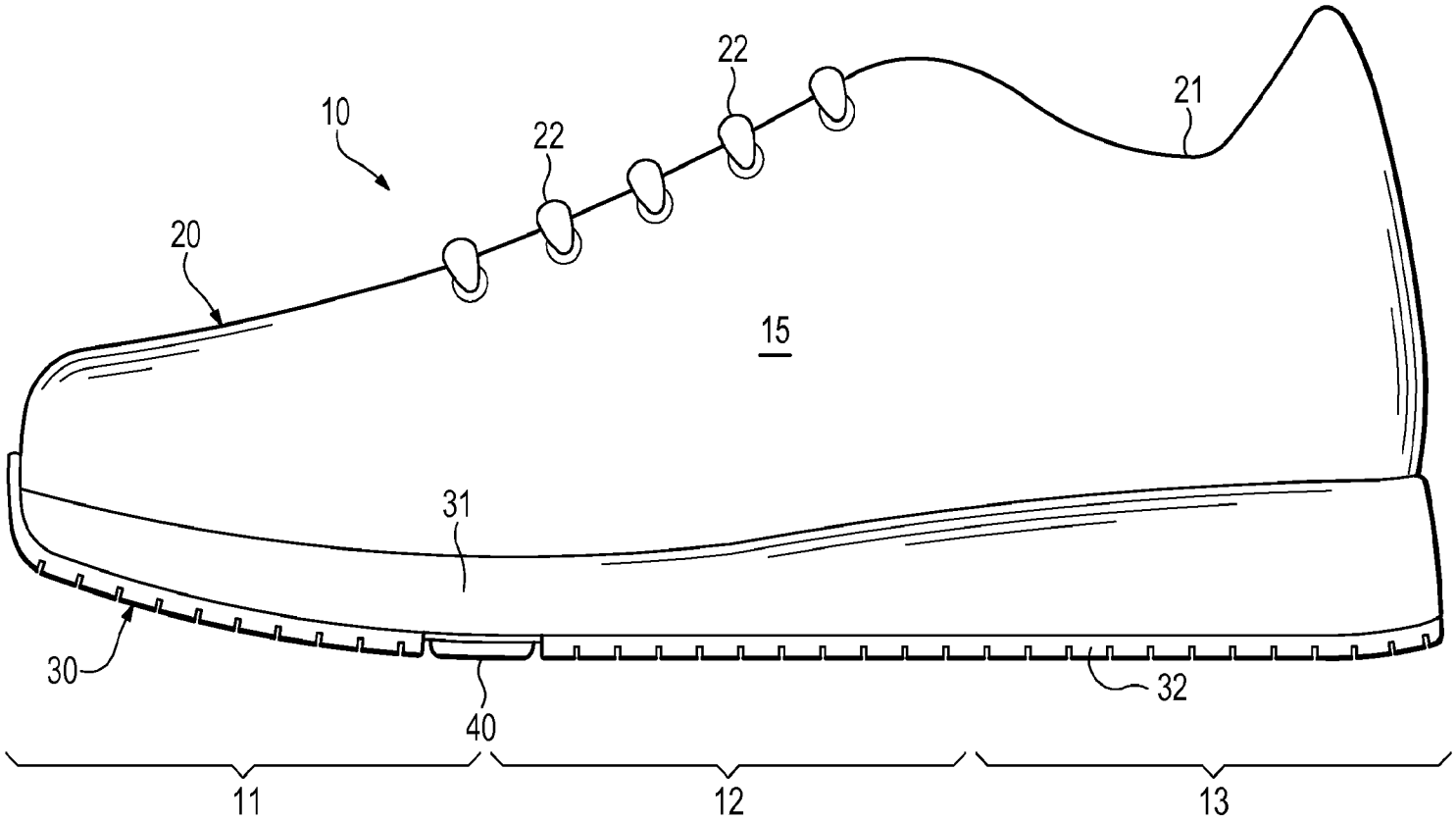
FIG. 2 is a medial side elevational view of the article of footwear.
Figure 3:
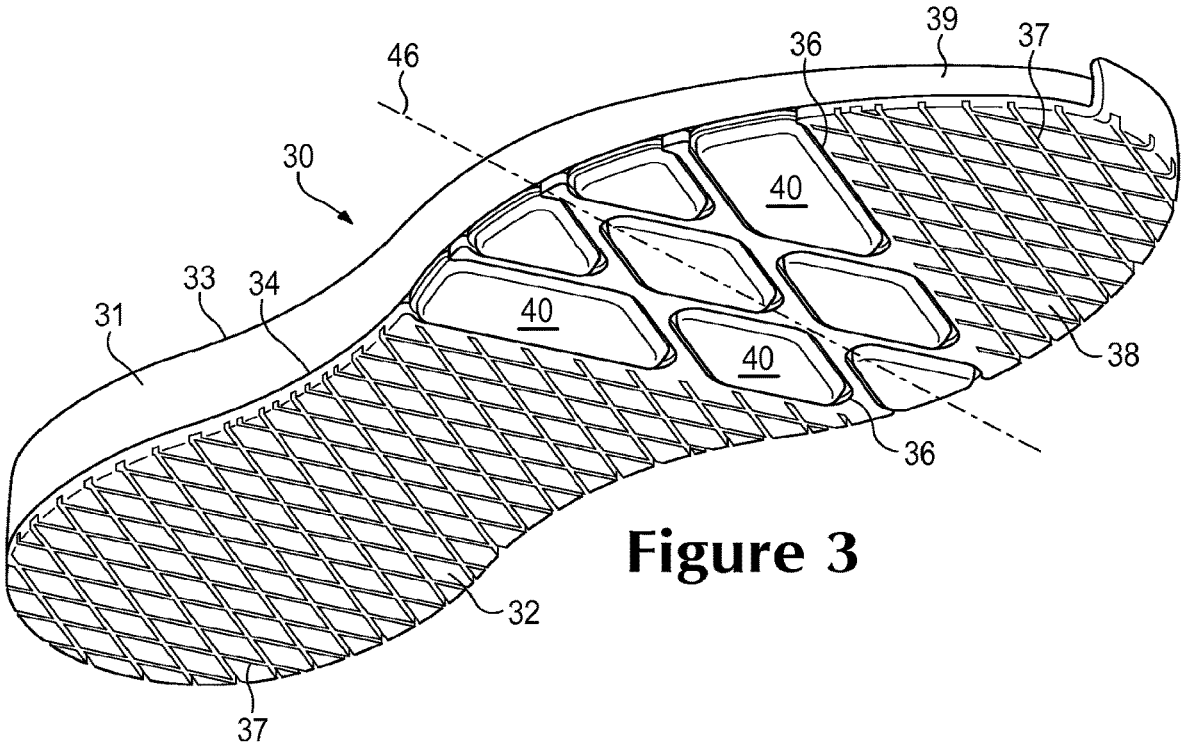
FIG. 3 is a perspective view of a sole structure of the article of footwear.
Figure 4:
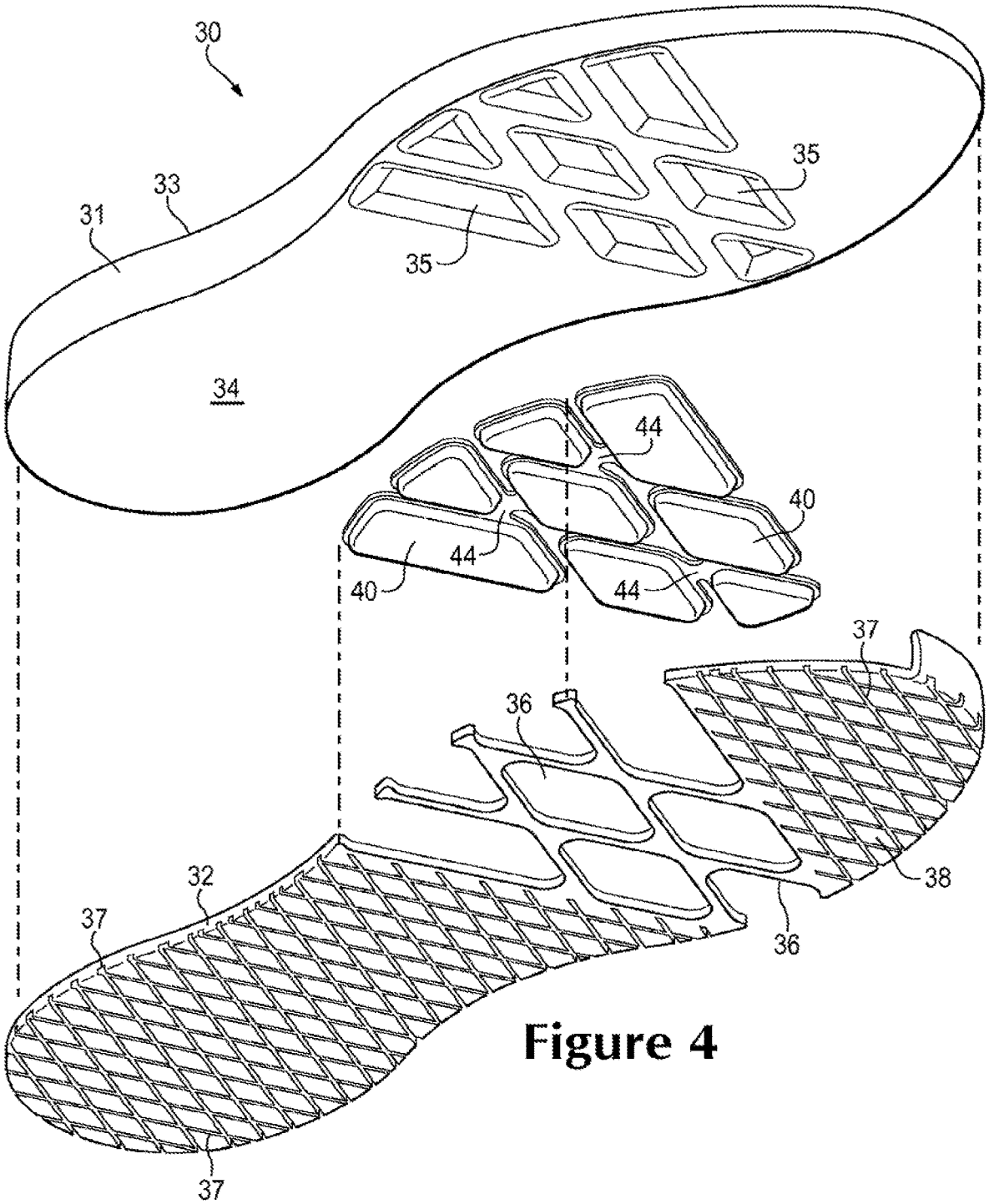
FIG. 4 is an exploded perspective view of the sole structure.
Figure 5:
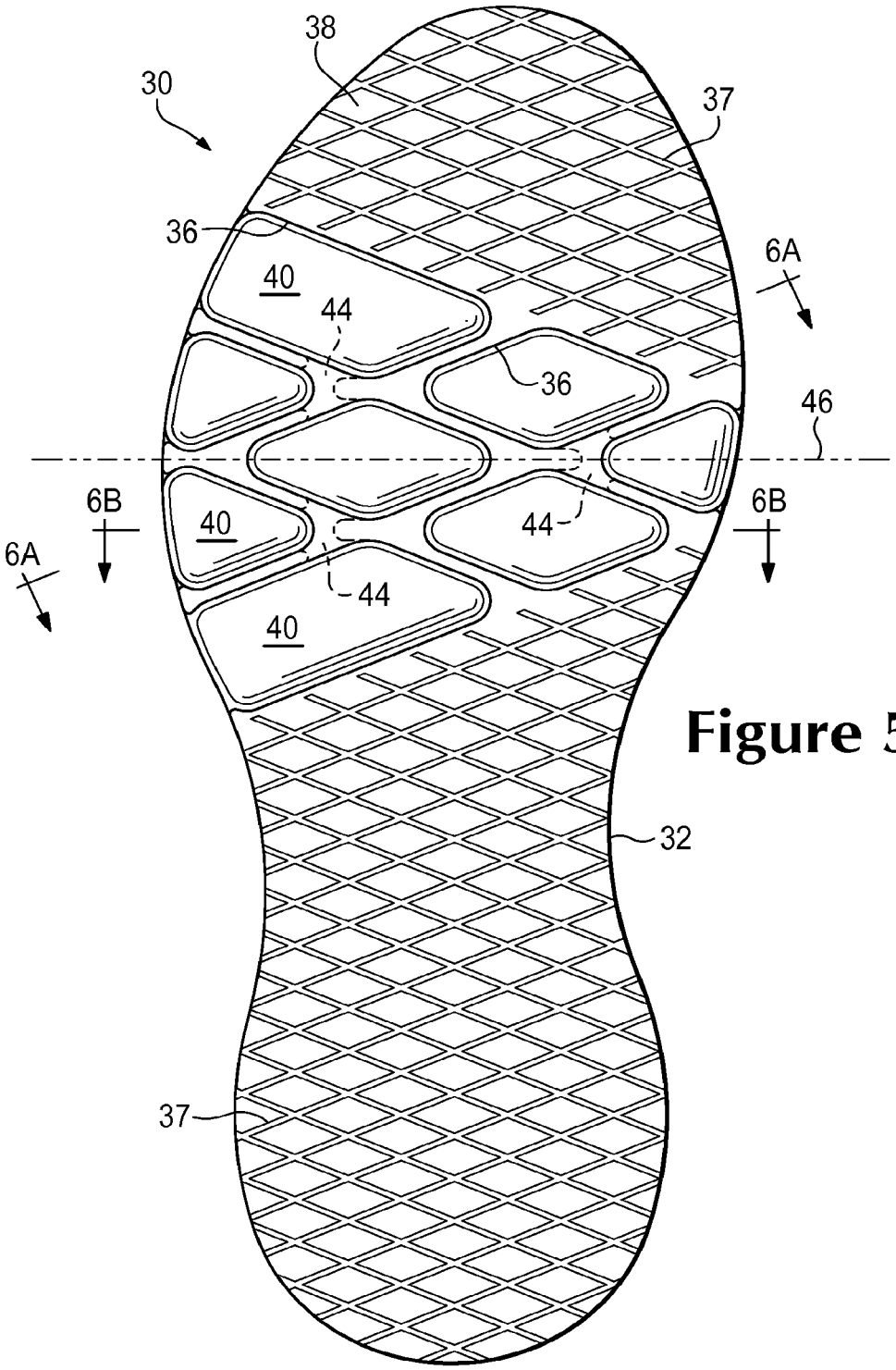
FIG. 5 is a bottom plan view of the sole structure.
Figure 6A:
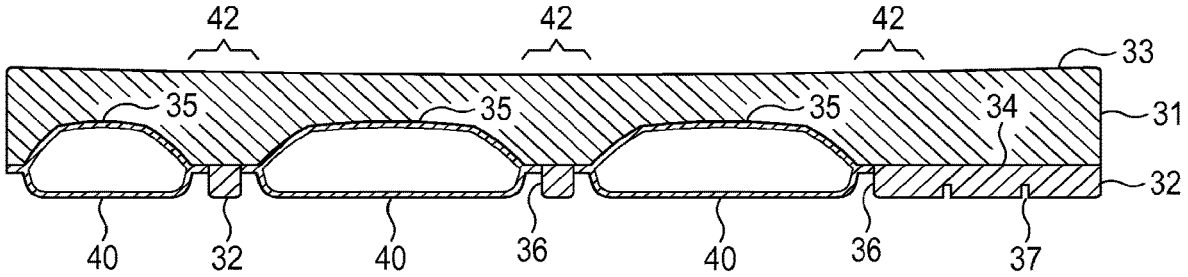
FIGS. 6A-6B are cross-sectional views of the sole structure, as defined by section lines 6A-6A through 6B-6B in FIG. 5.
Figure 6B:
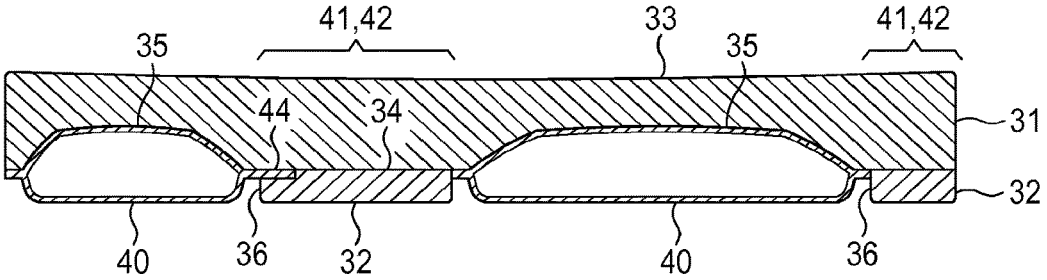
Figure 7:
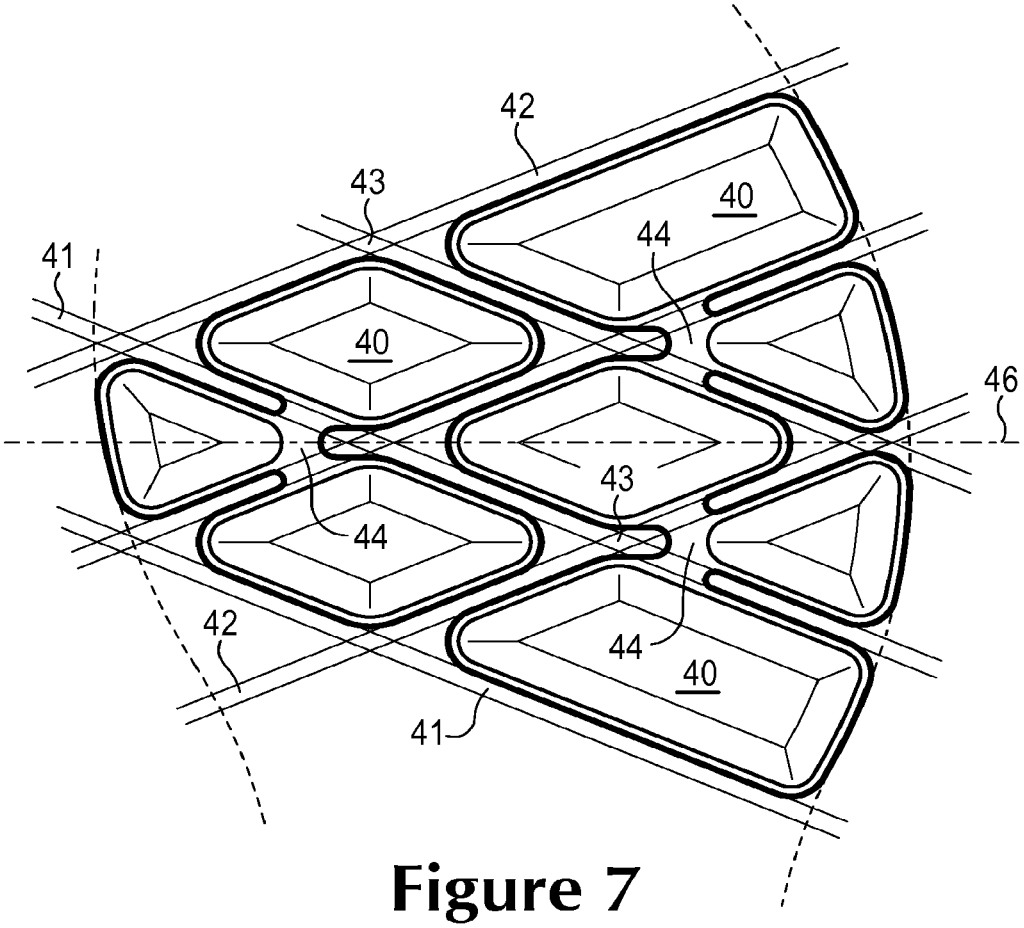
FIG. 7 is a top plan view of the chambers.
Figure 8:
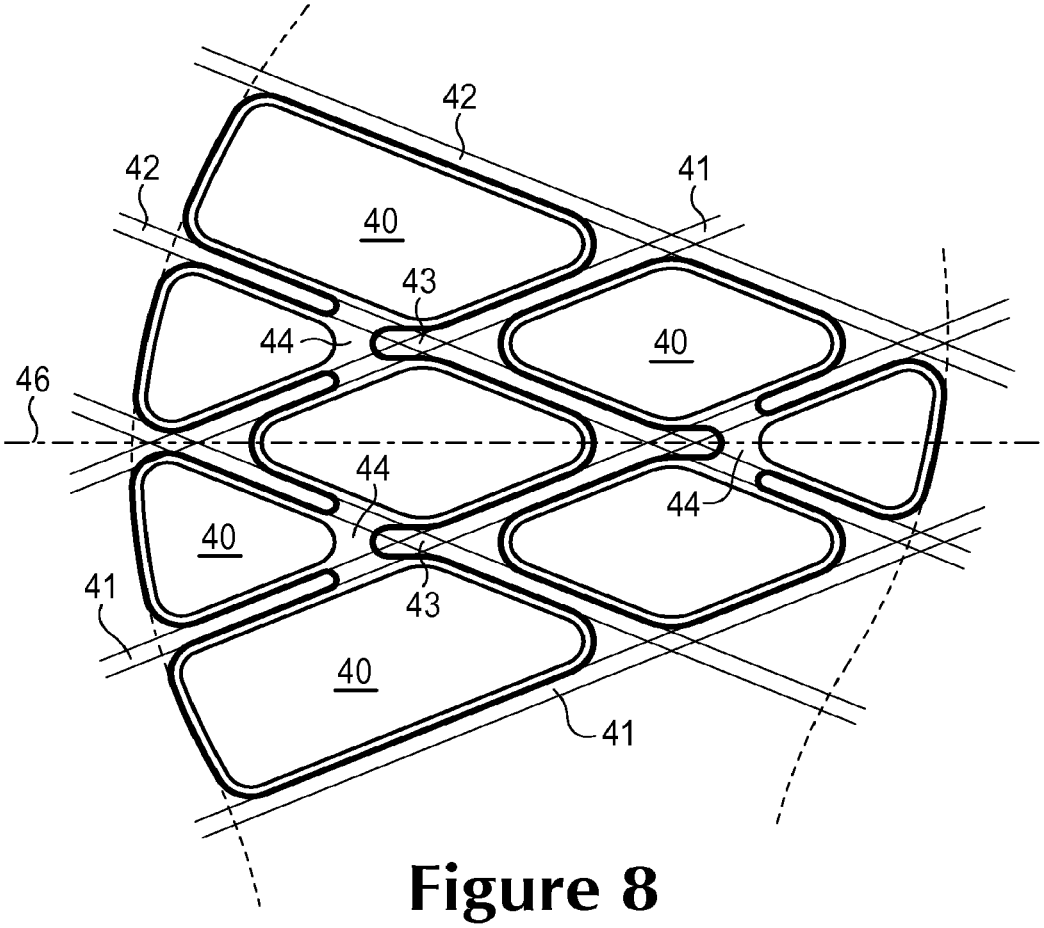
FIG. 8 is a bottom plan view of the chambers.
Figure 9:
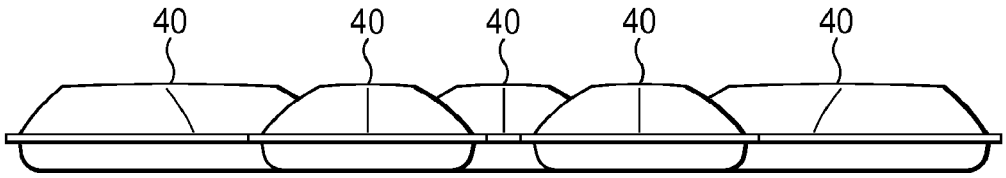
FIG. 9 is a lateral side elevational view of the chambers.
Figure 10:
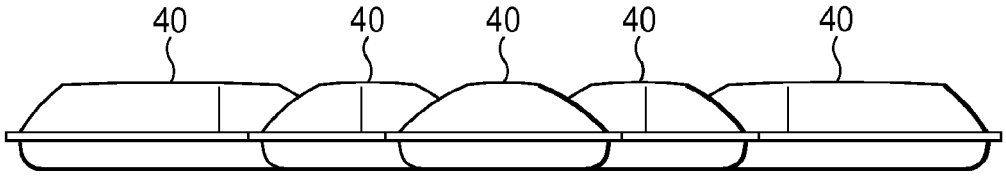
FIG. 10 is a medial side elevational view of the chambers.

An article of footwear 10 is depicted in FIGS. 1 and 2 as including an upper 20 and a sole structure 30. For reference purposes, footwear 10 may be divided into three general regions: a forefoot region 11, a midfoot region 12, and a heel region 13, as shown in FIGS. 1 and 2. Footwear 10 also includes a lateral side 14 and a medial side 15. Forefoot region 11 generally includes portions of footwear 10 corresponding with the toes and the joints connecting the metatarsals with the phalanges. Midfoot region 12 generally includes portions of footwear 10 corresponding with the arch area of the foot. Heel region 13 generally includes portions of footwear 10 corresponding with rear portions of the foot, including the calcaneus bone. Lateral side 14 and medial side 15 extend through each of regions 11-13 and correspond with opposite sides of footwear 10. Regions 11-13 and sides 14-15 are not intended to demarcate precise areas of footwear 10. Rather, regions 11-13 and sides 14-15 are intended to represent general areas of footwear 10 to aid in the following discussion. In addition to footwear 10, regions 11-13 and sides 14-15 may also be discussed with respect to the foot itself, upper 20, sole structure 30, and individual elements thereof.

Upper 20 is depicted as having a substantially conventional configuration incorporating a variety of material elements (e.g., textile, foam, leather, and synthetic leather) that are stitched or adhesively bonded together to form an interior void for securely and comfortably receiving a foot. The material elements may be selected and located with respect to upper 20 in order to selectively impart properties of durability, air-permeability, wear-resistance, flexibility, and comfort, for example. An ankle opening 21 in heel region 13 provides access to the interior void. In addition, upper 20 may include a lace 22 that is utilized in a conventional manner to modify the dimensions of the interior void, thereby securing the foot within the interior void and facilitating entry and removal of the foot from the interior void. Lace 22 may extend through apertures in upper 20, and a tongue portion of upper 20 may extend between the interior void and lace 22. Given that various aspects of the present application primarily relate to sole structure 30, upper 20 may exhibit the general configuration discussed above or the general configuration of practically any other conventional or nonconventional upper. Accordingly, the overall structure of upper 20 may vary significantly.

Sole structure 30 is secured to upper 20 and has a configuration that extends between upper 20 and the ground. In effect, therefore, sole structure 30 is located to extend between the foot and the ground. In addition to attenuating ground reaction forces (i.e., providing cushioning for the foot), sole structure 30 may provide traction, impart stability, and limit various foot motions, such as pronation.

Sole Structure Configuration

An initial configuration of sole structure 30, including midsole 31, outsole 32, and chambers 40, is depicted in FIGS. 3-10. The primary elements of sole structure 30 are a midsole 31, an outsole 32, and a plurality of fluid-filled chambers 40. Sole structure 30 may also incorporate an insole or sockliner that is located with in the void in upper 20 and adjacent a plantar (i.e., lower) surface of the foot to enhance the comfort of footwear 10.

Midsole 31 has an upper surface 33 positioned adjacent upper 20. Midsole 31 also has a lower surface 34 positioned adjacent outsole 32. Lower surface 34 defines a plurality of cavities 35 in midsole 31, each cavity (35) of the plurality of cavities (35) having a perimeter that is coplanar with the lower surface (34) of the midsole (31). Midsole 31 may include a polymer foam material, such as polyurethane or ethylvinylacetate. Midsole 31 may also incorporate one or more additional footwear elements that enhance the comfort, performance, or ground reaction force attenuation properties of footwear 10, including, plates, moderators, lasting elements, or motion control members.

Outsole 32, which may be partially or entirely absent in some configurations of footwear 10, is secured to lower surface 34 of midsole 31. Outsole 32 may form at least part of ground-contacting surface 38 of sole structure 30. Outsole 32 defines a plurality of apertures 36 aligned with cavities 35. Outsole 32 may be formed from a rubber material that provides a durable and wear-resistant surface for engaging the ground. In addition, outsole 32 may also be textured to enhance the traction (i.e., friction) properties between footwear 10 and the ground. In some configurations in which outsole 32 may be partially or entirely absent, midsole 31 may form at least part of a ground-contacting surface 38 of sole structure 30.

In the initial configuration, each of cavities 35 is formed distinctly from the others. In other configurations, two or more of cavities 35 may be formed to be interconnected with each other. Similarly, in the initial configuration, each of apertures 36 is formed distinctly from the others. In other configurations, two or more of apertures 36 may be formed to be interconnected with each other.

A plurality of fluid-filled chambers 40 extends between lateral side 14 and medial side 15 of sole structure 30 and is substantially located in forefoot region 11 and portions of midfoot region 12 of sole structure 30. Chambers 40 are at least partially located within cavities 35 and protrude outward from cavities 35. Chambers 40 extend into apertures 36. Accordingly, chambers 40 may also form part of ground-contacting surface 38. A top portion of each of chambers 40 has an inwardly-angled shape, and a bottom portion of each of chambers 40 has a substantially rectangular shape.

Some chambers 40 may be substantially diamond-shaped and may have obtuse angles and acute angles. As such, some chambers 40 are substantially equally spaced from each other and have edges that are substantially parallel with each other, and a distance between two such chambers 40 may be substantially constant along the nearest edges of the chambers. For example, in the initial configuration, the various chambers 40 located in a central area of sole structure 30 (i.e., in the area centrally-located between sides 14 and 15) and spaced inward from sides 14 and 15 are substantially diamond-shaped. Each centrally-located and inwardly-spaced chamber 40 has two obtuse angles (pointing toward forefoot region 11 and heel region 13) and two acute angles (pointing toward lateral side 14 and medial side 15). Other chambers may have other shapes. For example, in the initial configuration, the chambers 40 located adjacent to sides 14 and 15 have shapes of triangles or truncated diamonds. Each truncated chamber 40 located adjacent to sides 14 and 15 has at least one acute angle (pointing toward lateral side 14 or medial side 15), and may have one or two obtuse angles (pointing toward forefoot region 11 and heel region 13).

A sidewall surface 39 of sole structure 30 extends between upper surface 33 of midsole 31 and ground-contacting surface 38. Part of sidewall surface 39 on lateral side 14 is formed by the chamber 40 adjacent to the lateral side, and part of sidewall surface 39 on medial side 15 is formed by the chamber 40 adjacent to the medial side. An advantage of chambers 40 forming part of sidewall surface 39 is that characteristics of chambers 40 such as their presence, extent, placement, or configuration may be visible on an exterior of footwear 10.

In the initial configuration, the plurality of chambers 40 includes three centrally-located and inwardly-spaced chambers 40, four chambers 40 adjacent to lateral side 14, and one chamber 40 adjacent to lateral side 15. In further configurations, the plurality of chambers 40 may include any number of centrally-located and inwardly-spaced chambers 40, and any number of chambers 40 adjacent to sides 14 and 15.

The plurality of chambers 40 may have a configuration of an array having a number of rows N and a number of columns M, implying positions for a number of chambers N×M. For example, in an initial configuration, the array of chambers 40 may have a configuration of an arrangement of three rows and three columns, implying positions for nine chambers 40 (eight of which coincide with the extent of the sole structure, the ninth implied position being outside the footprint of footwear 10). Other configurations of arrays of chambers 40 may imply positions for more chambers 40 or for fewer chambers 40 than in the initial configuration. Additionally, the array of chambers 40 may imply positions for more chambers 40 or for fewer chambers 40 than are actually in the array of chambers 40.

A plurality of first bounding regions 41 and a plurality of second bounding regions 42 are also defined within sole structure 30. Bounding regions 41 and 42 are substantially linear regions of sole structure 30 separating chambers 40 and adjacent to chambers 40. First bounding regions 41 are substantially straight and parallel with each other, and second bounding regions 42 are substantially straight and parallel with each other. Bounding regions 41 and 42 may be formed of portions of midsole 31, such as polymer foam portions. Chambers 40 are at least partially bounded by bounding regions 41 and 42. Some chambers, such as centrally-located and inwardly-spaced chambers 40, may be entirely bounded by bounding regions 41 and 42. Other chambers, such as chambers located adjacent to sides 14 and 15, may only be partially bounded by bounding regions 41 and 42. Additionally, a majority of the perimeter of each chamber abuts or is immediately adjacent to substantially linear bounding regions 41 and 42. Accordingly, a majority of a perimeter of each chamber 40 is bounded by bounding regions 41 and 42.

Bounding regions 41 and 42 may be oriented at an angle with respect to a mediolateral axis 46 of footwear 10. Mediolateral axis 46 extends between sides 14 and 15 and is generally perpendicular to a longitudinal axis of footwear 10 (i.e., an axis extending along a length of footwear 10). First bounding regions 41 may be oriented at a first angle with respect to mediolateral axis 46 of footwear 10, and second bounding regions 42 may be oriented at a second angle with respect to mediolateral axis 46. That is, first bounding regions 41 may be oriented to face one portion of footwear 10, such as lateral side 14 of forefoot region 11, and second bounding regions 42 may be oriented to face a second portion of footwear 10, such as medial side 15 of forefoot region 11. For example, in the initial configuration, first bounding regions 41 are oriented at a first angle of about 30 degrees with respect to mediolateral axis 46 of footwear 10, and second bounding regions 42 are oriented at a second angle of about 30 degrees with respect to mediolateral axis 46, such that the total angle between bounding regions 41 and 42 is about 60 degrees.

First bounding regions 41 meet second bounding regions 42 at intersections 43. Intersections 43 may have one or two obtuse angles, oriented to face forefoot region 11 or heel region 13. Similarly, intersections 43 may have one or two acute angles, oriented to face lateral side 14 or medial side 15.

Some physical properties of bounding regions 41 and 42 may be substantially different from the physical properties of chambers 40. For example, bounding regions 41 and 42 may stretch, compress, bend, or flex differently than chambers 40. As a result, sole structure 30 may stretch, compress, bend, or flex differently at bounding regions 41 and 42 than at chambers 40. An advantage of such a configuration of chambers 40 and bounding regions 41 and 42 is that sole structure 30 may have some physical properties, such as ground reaction force attenuation properties, related to chambers 40, as well as other physical properties related to bounding regions 41 and 42 between chambers 40. A further advantage of such a configuration of chambers 40 and bounding regions 41 and 42 is that sole structure 30 may have a multi-directional flexibility. In other words, sole structure 30 may be relatively more flexible in directions associated with and running normal to or perpendicular to bounding regions 41 and 42, and may be relatively less flexible in other directions. Accordingly, since bounding regions 41 and 42 may be oriented at two different angles with respect to mediolateral axis 46, sole structure 30 may have a preferential flexibility in more than one direction.

Outsole 32 may have a plurality of flexion lines 37. Flexion lines 37 may be substantially straight linear indentations extending upward from a bottom surface of footwear 10 in a rubber material of outsole 32, and may extend between lateral side 14 and medial side 15. Outsole 32 may bend or flex more easily at flexion lines 37 than at other positions. In some embodiments, flexion lines 37 may, in turn, be aligned with bounding regions 41 and 42. In such embodiments, some edges of the shapes of chambers 40 may be substantially parallel to a first portion of flexion lines 37, such as a portion of flexion lines 37 facing lateral side 14 of forefoot region 11. Similarly, some edges of the shapes of chambers 40 may be substantially parallel to a second portion of flexion lines 37, such as a portion of flexion lines 37 facing medial side 15 of forefoot region 11.

Chambers 40 are connected by a plurality of connections 44. In the initial configuration, chambers 40 are connected to each other by a minimally sufficient number of connections, each of which is substantially parallel to mediolateral axis 46 of footwear 10. In further embodiments, one or more of chambers 40 may be in fluid connection with each other through connections 44. In other embodiments, chambers 40 and connections 44 may be formed as parts of a single polymer element.

Chambers 40 may be manufactured through a variety of manufacturing techniques, including blowmolding, thermoforming, and rotational molding, for example. The manufacturing process (a) imparts shape to one polymer sheet in order to form an upper portion of chambers 40, and (b) imparts shape to the other polymer sheet in order to form a lower portion of chambers 40. With regard to the blowmolding technique, thermoplastic material is placed in a mold having the general shape of chambers 40 and pressurized air is utilized to induce the material to coat surfaces of the mold. In the thermoforming technique, layers of thermoplastic material are placed between corresponding portions of a mold, and the mold is utilized to compress the layers together at peripheral locations of chambers 40. A positive pressure may be applied between the layers of thermoplastic material to induce the layers into the contours of the mold. In addition, a vacuum may be induced in the area between the layers and the mold to draw the layers into the contours of the mold. In the rotational molding technique, thermoplastic material is placed in a mold that subsequently rotates to induce the thermoplastic material to coat surfaces of the mold. Additionally, a process disclosed in U.S. patent application Ser. No. 12/630,695, entitled Fluid-Filled Structure and filed on 3 Dec. 2009, may be utilized to manufacture chambers 40, such application being incorporated herein by reference.

Each of chambers 40 has a generally hollow configuration that encloses a fluid (e.g., a gas, liquid, gel). Bonds may extend around chambers 40 to prevent the fluid from escaping chambers 40 or passing between chambers 40, thereby isolating the various chambers 40 from fluid communication with each other. In other configurations, conduits extending between chambers 40 (e.g., through connections 44) may place chambers 40 in fluid communication with each other. The fluid within chambers 40 may be pressurized between zero and three-hundred-fifty kilopascals (i.e., approximately fifty-one pounds per square inch) or more. In addition to air and nitrogen, the fluid may include any of the gasses disclosed in U.S. Pat. No. 4,340,626 to Rudy.

Various polymer materials may be utilized for chambers 40. In selecting a material for chambers 40, the ability of the material to prevent the diffusion of the fluid contained by each of chambers 40 may be considered, as well as the engineering properties of the material (e.g., tensile strength, stretch properties, fatigue characteristics, dynamic modulus, and loss tangent). Examples of thermoplastic polymer materials that may be suitable for chambers 40 include urethane, polyurethane, polyester, polyester polyurethane, and polyether polyurethane. Various thermoset polymer materials may also be utilized for chambers 40. More specific examples of materials that may be utilized for chambers 40 include the various materials disclosed in any of (a) U.S. Pat. Nos. 4,183,156, 4,219,945, 4,936,029, and 5,042,176 to Rudy; (b) U.S. Pat. Nos. 5,713,141 and 5,952,065 to Mitchell, et al.; and (c) U.S. Pat. Nos. 6,013,340, 6,082,025, 6,127,026, 6,203,868, and 6,321,465 to Bonk, et al.

Additionally, in some configurations, any of chambers 40 may include any of a range of tensile members, such as the tensile members disclosed in U.S. patent application Ser. No. 12/123,612 to Dua and U.S. patent application Ser. No. 12/123,646 to Rapaport, et al. Moreover, in some configurations, any of chambers 40 may include any of a range of tether elements, such as the tether elements disclosed in U.S. patent application Ser. No. 12/630,642 to Peyton and U.S. patent application Ser. No. 12/777,167 to Peyton. Furthermore, in some configurations, any of chambers 40 may include any of a range of foam tensile members, such as the foam tensile members disclosed in U.S. Pat. No. 7,131,218 to Schindler, U.S. Pat. No. 7,588,654 to Schindler et al., and U.S. Pat. No. 7,591,919 to Schindler et al.

Further Configurations

Figure 11A:
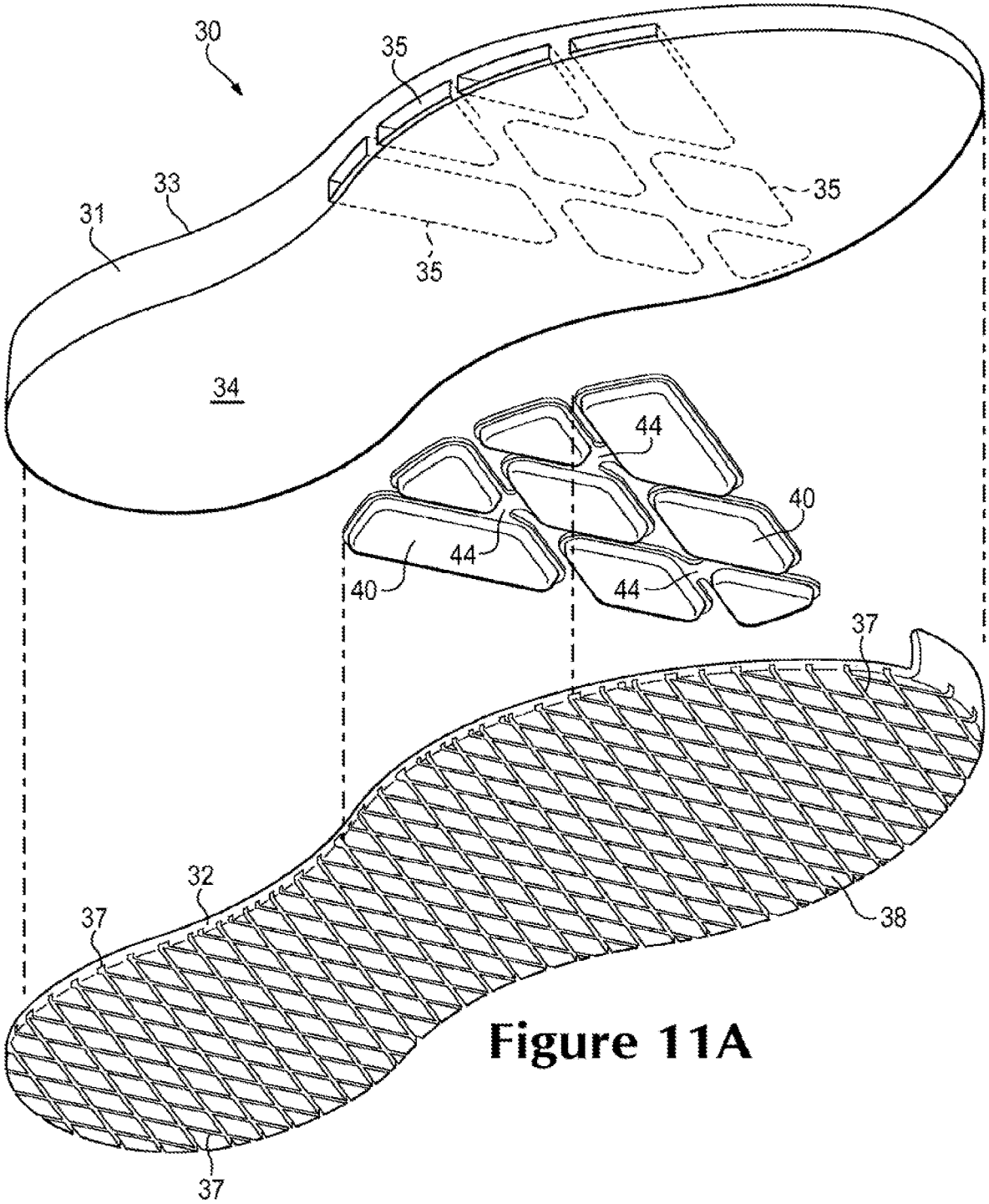
FIGS. 11A-11C are exploded perspective views depicting additional configurations of the sole structure, corresponding with FIG. 4.

Sole structure 30 incorporating chambers 40 may have other configurations. In the initial configuration of sole structure 30, lower surface 34 of midsole 31 defines a plurality of cavities 35. In further configurations, cavities 35 may be defined by other portions of midsole 31. For example, with reference to FIG. 11A, a plurality of cavities 35 may be formed within an interior portion of midsole 31 between upper surface 33 and lower surface 34. Alternatively, upper surface 33 of midsole 31 may define a plurality of cavities 35. In other configurations, cavities 35 may be partially defined by or formed within any combination of upper surface 33, lower surface 34, or an interior portion of midsole 31.

Figure 11B:
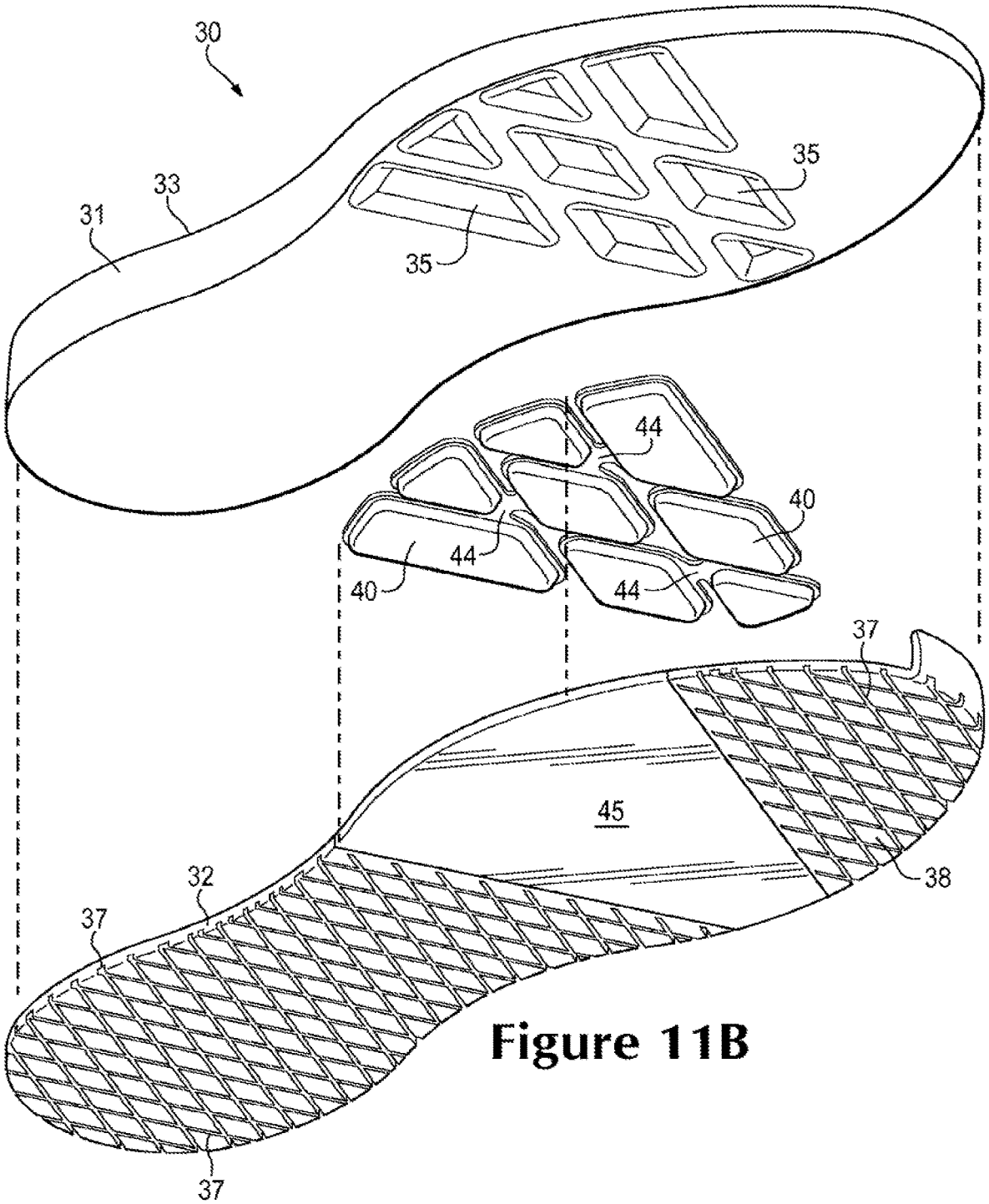

In the initial configuration, outsole 32 defines a plurality of apertures 36 aligned with cavities 35. In further configurations, apertures 36 may be absent from outsole 32. For example, with reference to FIGS. 11A and 11B, outsole 32 may not define a plurality of apertures 36, but may instead extend over and cover chambers 40 within cavities 35 in midsole 31. In other configurations, outsole 32 may be absent from regions of sole structure 30 through which chambers 40 extend. Alternatively, in some configurations, outsole members (i.e., portions of outsole 32) may extend over and cover portions of the lower surfaces of chambers 40. In such configurations, a portion of the lower surface of one or more of chambers 40 may be positioned adjacent to a portion of outsole 32. That is, one or more of chambers 40 may be at least partially covered by pieces of outsole 32.

In some configurations of sole structure 30, outsole 32 may be formed of a substantially opaque rubber material. In other configurations, outsole 32 may include an at least partially transparent portion 45. For example, with reference to FIG. 11B, outsole 32 may include a substantially clear rubber portion beneath and adjacent to cavities 35, chambers 40, and connections 44. Partially transparent portion 45 may extend through a portion of forefoot region 11 of outsole 32, or any other portion or portions of outsole 32.

In the initial configuration, part of sidewall surface 39 on lateral side 14 is formed by the chamber 40 adjacent to the lateral side, and part of sidewall surface 39 on medial side 15 is formed by the chamber 40 adjacent to the medial side. In other configurations, chambers 40 may form part of sidewall surface 39 on only lateral side 14, or may form part of sidewall surface 39 only on medial side 15, or may not form any part of sidewall surface 39.

Figure 11C:
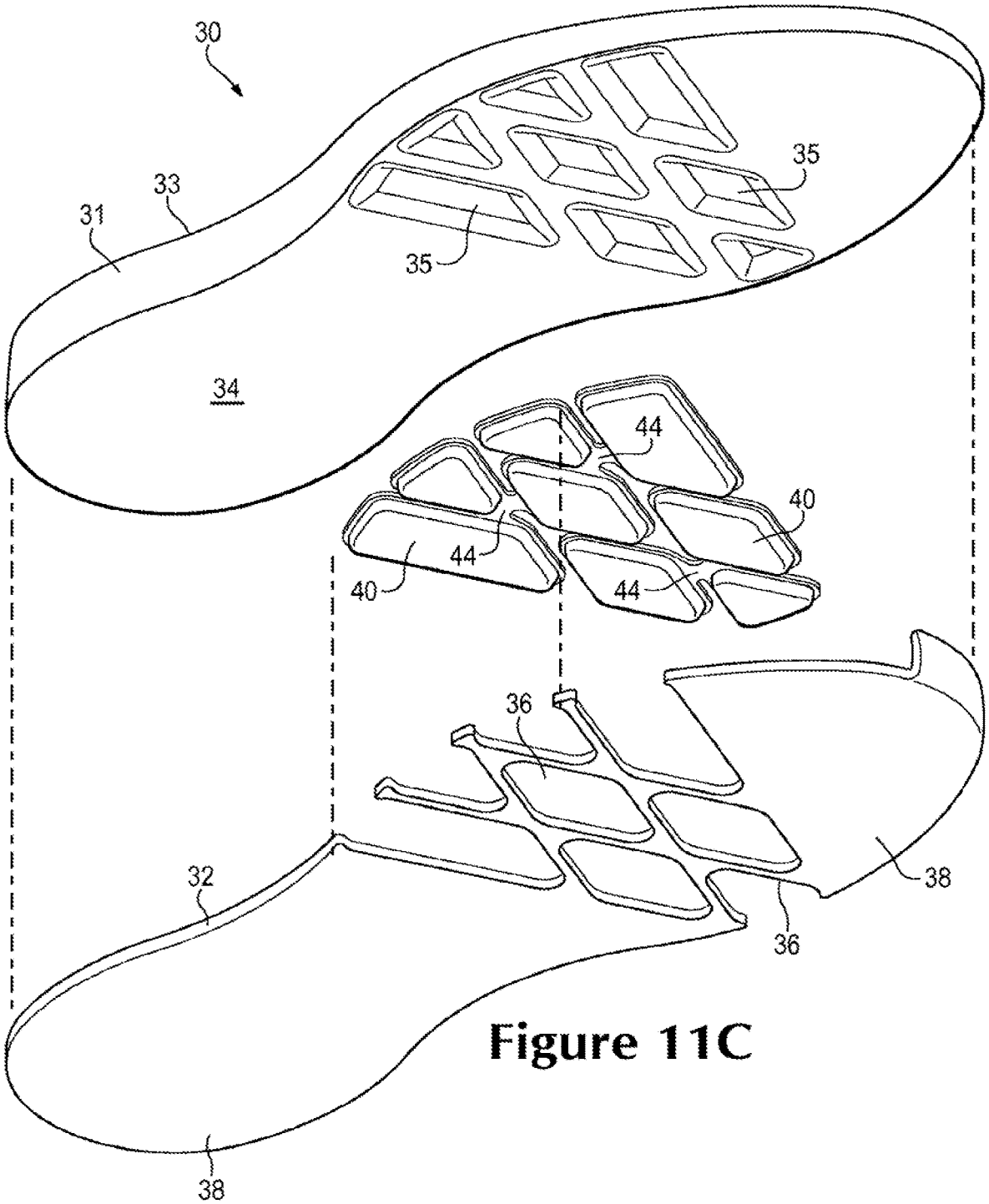

In the initial configuration of sole structure 30, outsole 32 includes a plurality of flexion lines 37 that are substantially straight and linear, are aligned with or substantially parallel to some edges of chambers 40, and extend between lateral side 14 and medial side 15. In other configurations, outsole 32 may include flexion lines having alternate configurations, or no flexion lines at all. For example, with reference to FIG. 11C, outsole 32 may not include any flexion lines. In some alternate configurations, outsole 32 may include flexion lines that are not substantially straight, such as flexion lines that include curves or angles, or may include flexion lines that do not extend between lateral side 14 and medial side 15, such as flexion lines that span only a portion of the distance between lateral side 14 and medial side 15. In other alternate configurations, flexion lines may not be substantially parallel to some edges of chambers 40, but may instead be perpendicular to edges of chambers 40, or may meet edges of chambers 40 at substantially consistent angles over outsole 32, or may have no relationship at all with edges of chambers 40. In yet other alternate configurations, outsole 32 may include only flexion lines that are substantially parallel with first bounding regions 41, or only flexion lines that are substantially parallel with second bounding regions 42.

In the initial configuration, first bounding regions 41 and second bounding regions 42 may be formed of and include portions of midsole 31, such as polymer foam portions. In further configurations, bounding regions 41 and 42 may be formed of and include portions of outsole 32, such as rubber portions. Alternatively, bounding regions 41 and 42 may be formed of and include a gap between chambers 40, such as a gap between chambers 40 from which polymer foam material is absent.

Figure 12A:
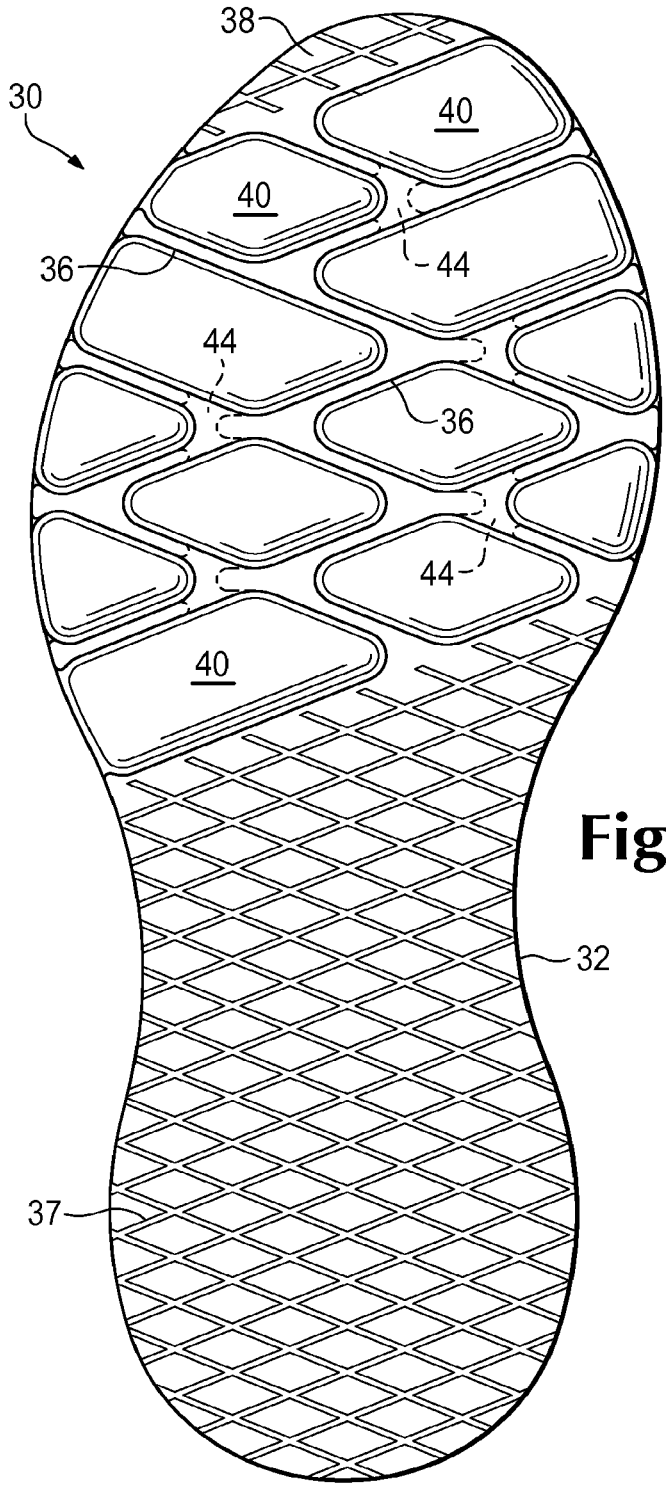
FIGS. 12A-12C are bottom plan views depicting further configurations of the sole structure, corresponding with FIG. 5.
Figure 12B:
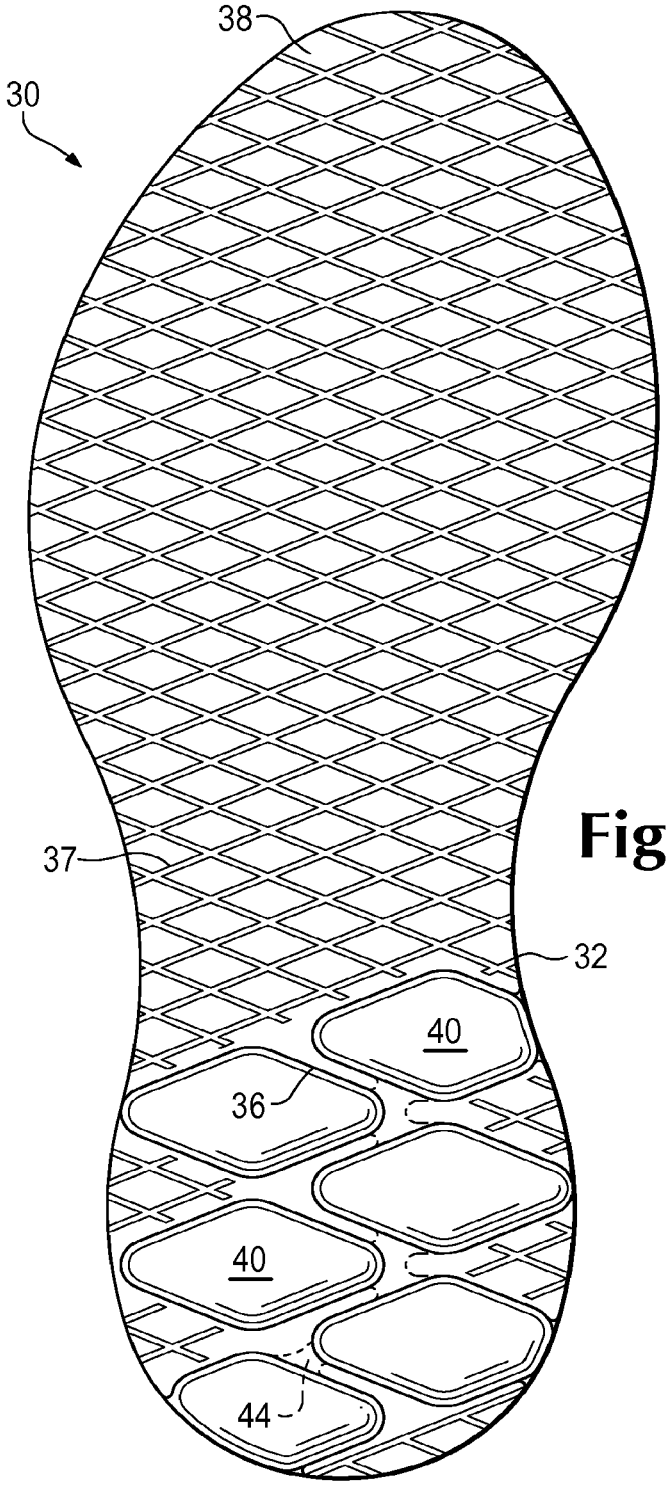
Figure 12C:
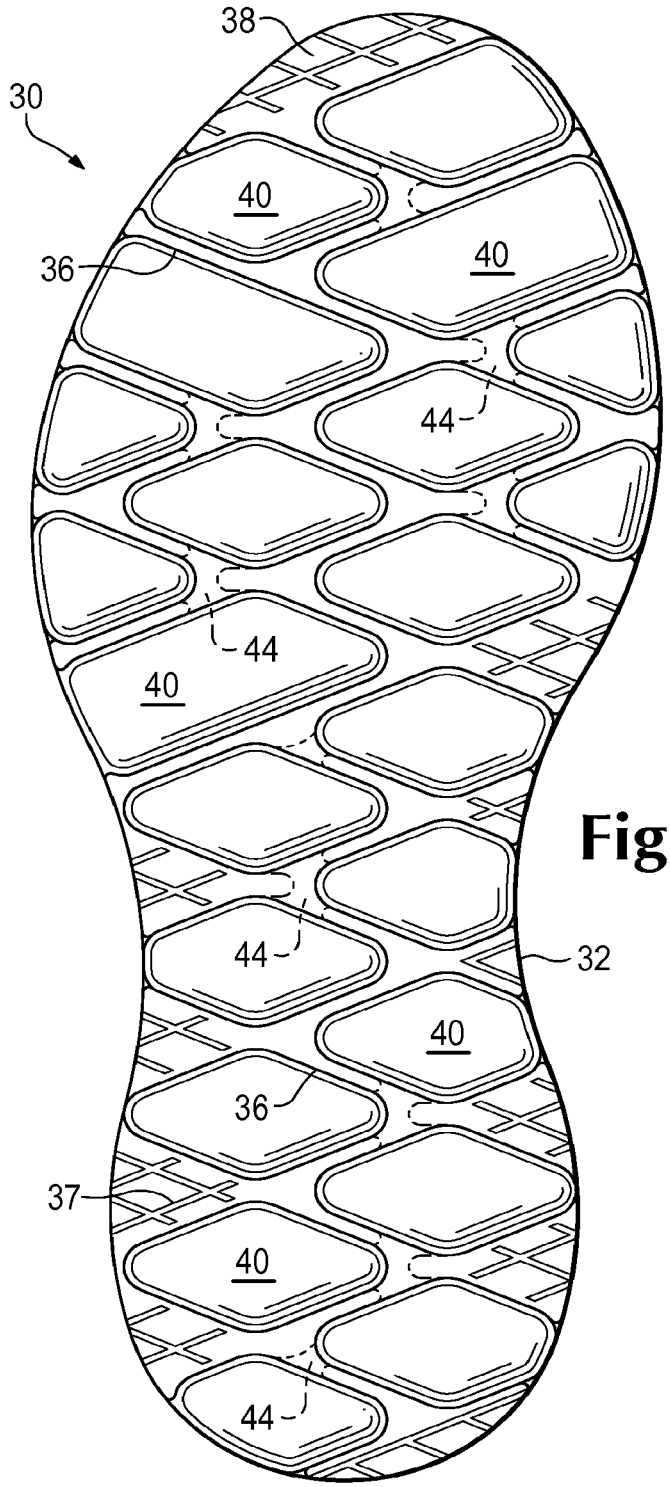

In the initial configuration, chambers 40 extend between lateral side 14 and medial side 15 and are substantially located in forefoot region 11 and portions of midfoot region 12 of sole structure 30. In further configurations, chambers 40 may extend across any portion or portions of sole structure 30. For example, with reference to FIG. 12A, chambers 40 extend across sole structure 30 further than in the initial configuration, in both the direction of the forefoot and the direction of the heel. In another example, with reference to FIG. 12B, chambers 40 extend between lateral side 14 and medial side 15 and are substantially located in heel region 13 of sole structure 30. In a further example, with reference to FIG. 12C, chambers 40 extend between lateral side 14 and medial side 15, and between forefoot region 11 and heel region 13, or across substantially all of sole structure 30.

Figure 13A:
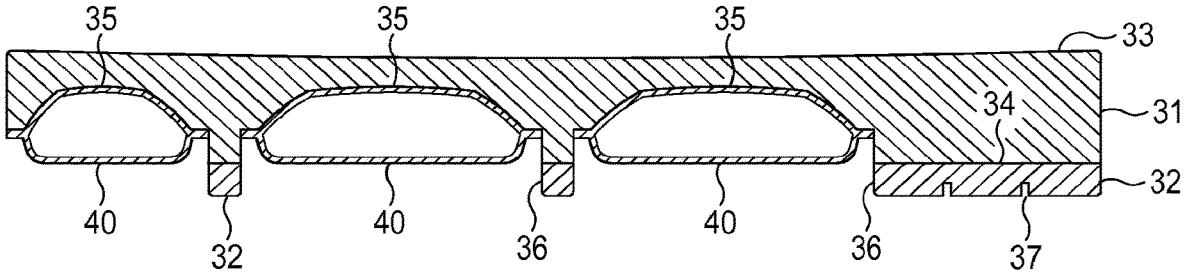
FIGS. 13A-13C are cross-sectional views depicting additional configurations of the sole structure, corresponding with FIG. 6A.
Figure 13B:
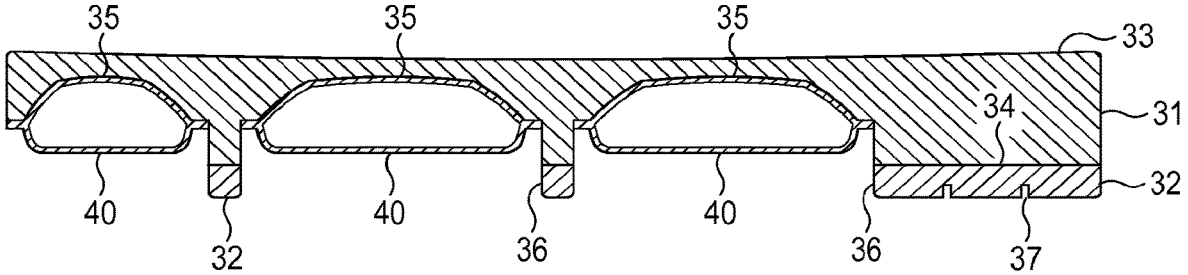
Figure 13C:
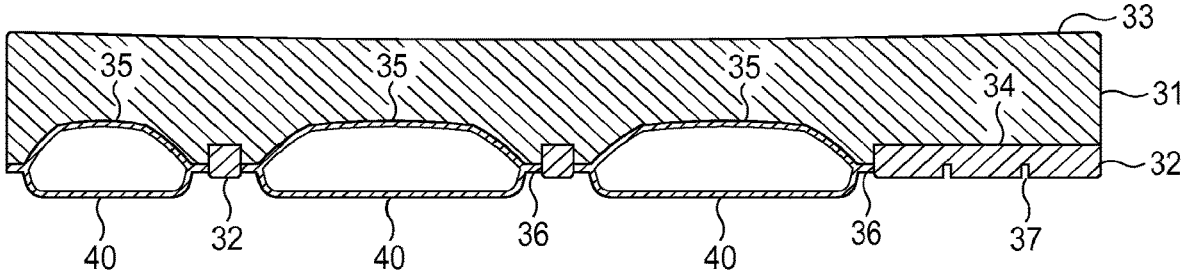

In the initial configuration, chambers 40 protrude outward from cavities 35 and extend into apertures 36 in outsole 32. In further configurations, chambers 40 may have an alternate extent. For example, with reference to FIG. 13A, in some configurations, chambers 40 may not protrude outward from cavities 35 or extend into apertures 36 in outsole 32. In another example, with reference to FIG. 13B, chambers 40 may be recessed within cavities 35. In a further example, with reference to FIG. 13C, chambers 40 may protrude outward from cavities 35 and also protrude outward from apertures 36 in outsole 32. As discussed above, in such configurations, one or more of chambers 40 may be at least partially covered by pieces of outsole 32. For example, chambers 40 of the configuration depicted in FIG. 13C may be partially covered by pieces of outsole 32.

Figure 14A:
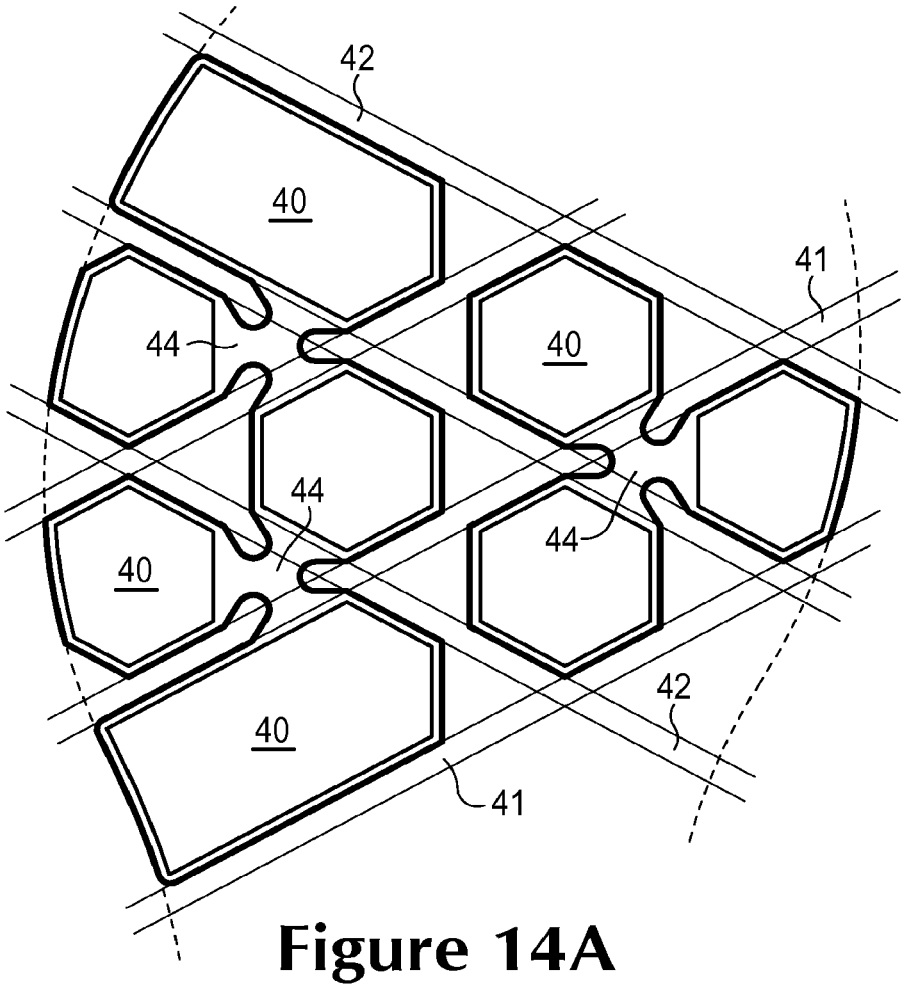
FIGS. 14A-14Q are bottom plan views depicting further configurations of the chambers, corresponding with FIG. 8.
Figure 14B:
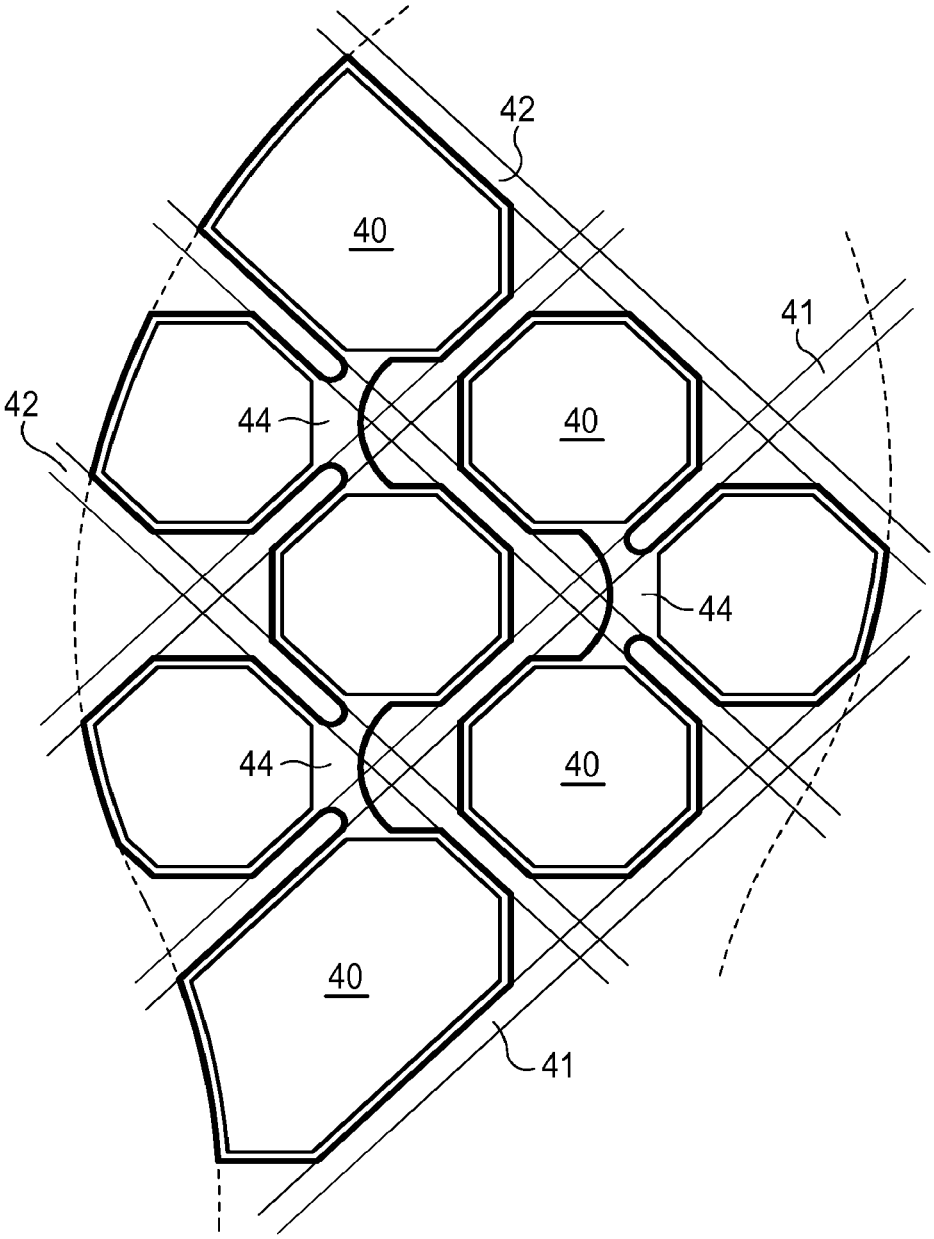
Figure 14C:
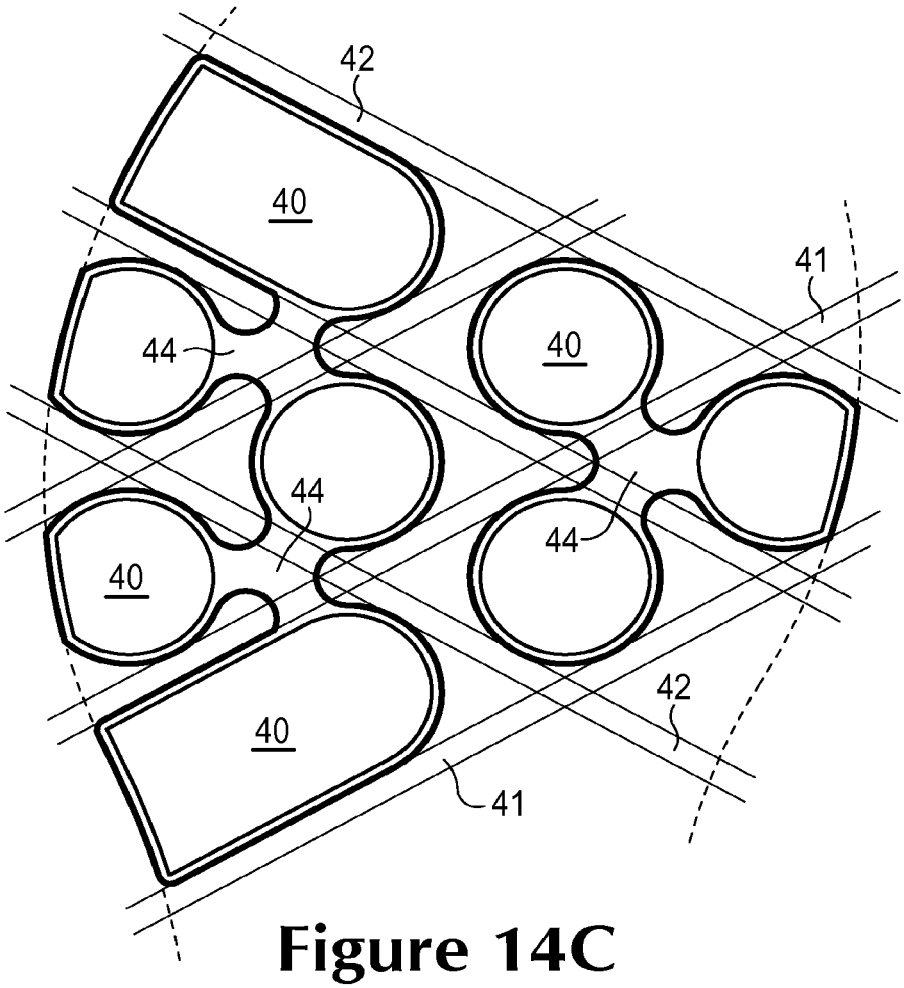
Figure 14D:
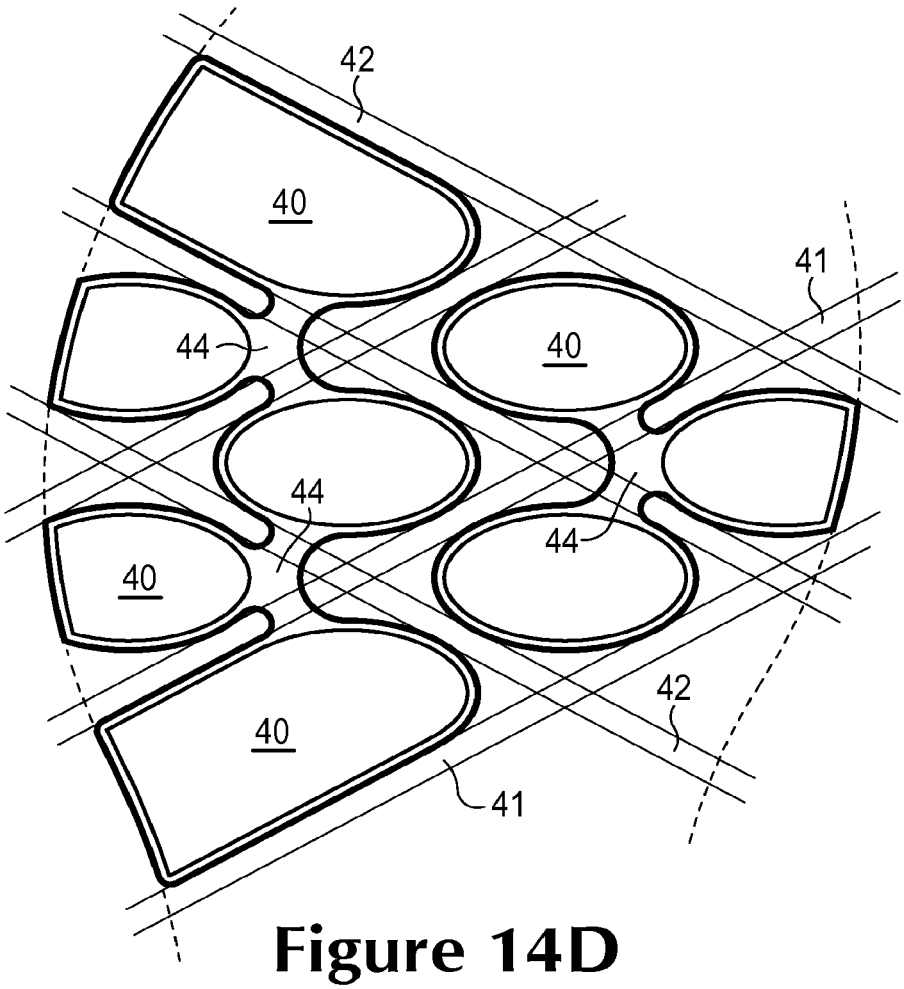
Figure 14E:
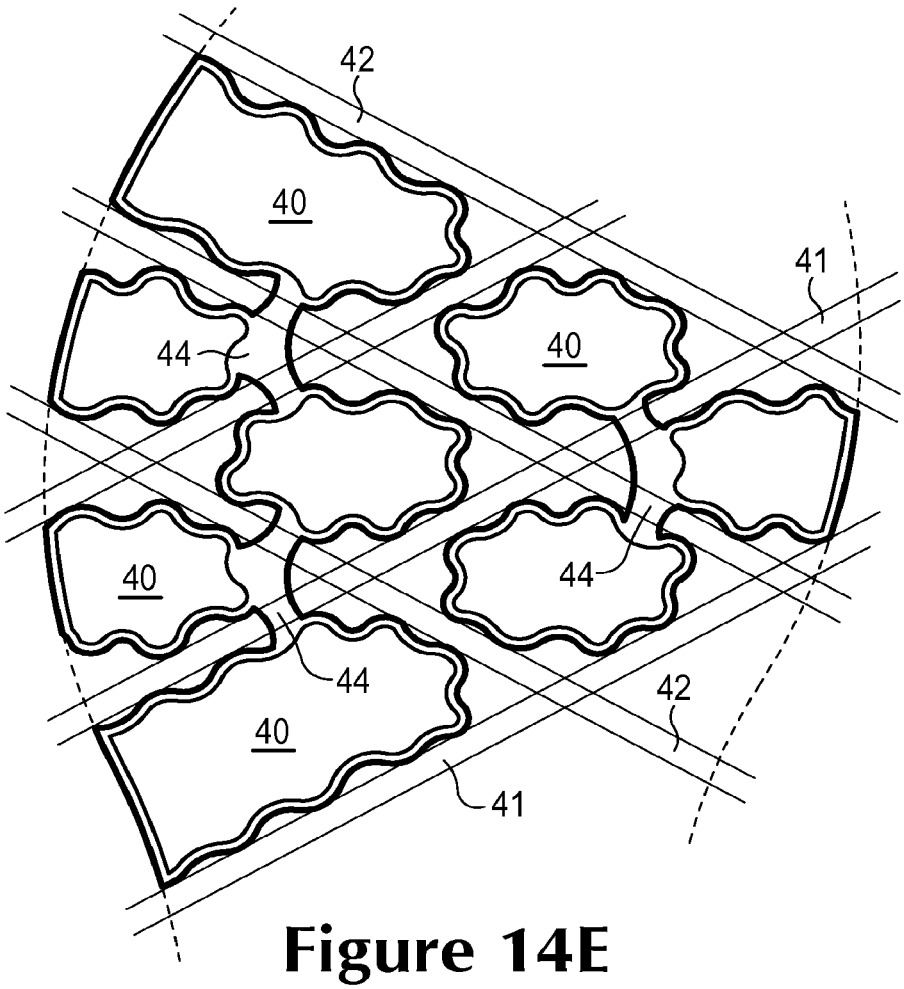

In the initial configuration, a centrally-located and inwardly-spaced portion of chambers 40 are substantially diamond-shaped. In further configurations, a centrally-located and inwardly-spaced portion of chambers 40 may have other shapes. In such configurations, chambers 40 may also be partially bounded by bounding regions 41 and 42. For example, with reference to FIGS. 14A-14D, chambers 40 may have substantially hexagonal shapes, substantially octagonal shapes, substantially circular shapes, or substantially elongated or elliptical shapes. Chambers 40 may have any shape, regular or irregular. For example, with reference to FIG. 14E, chambers 40 may have an irregular shape including lobes and indentations.

Figure 14F:
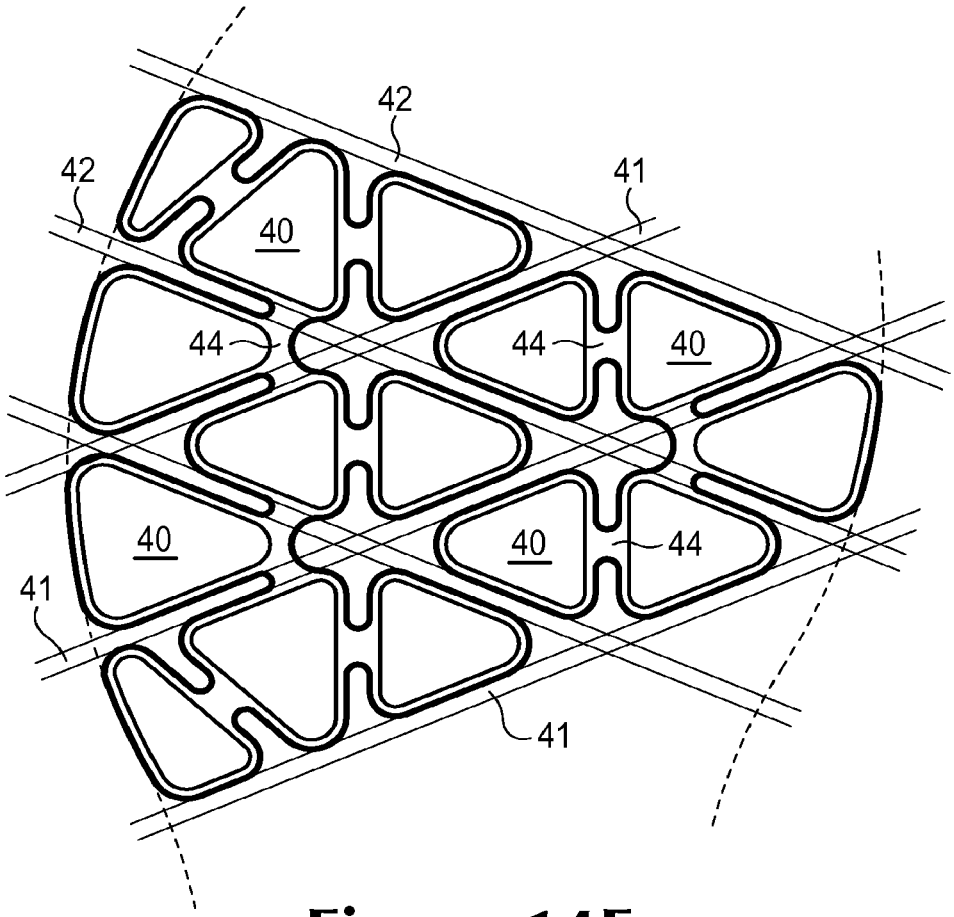
Figure 14G:
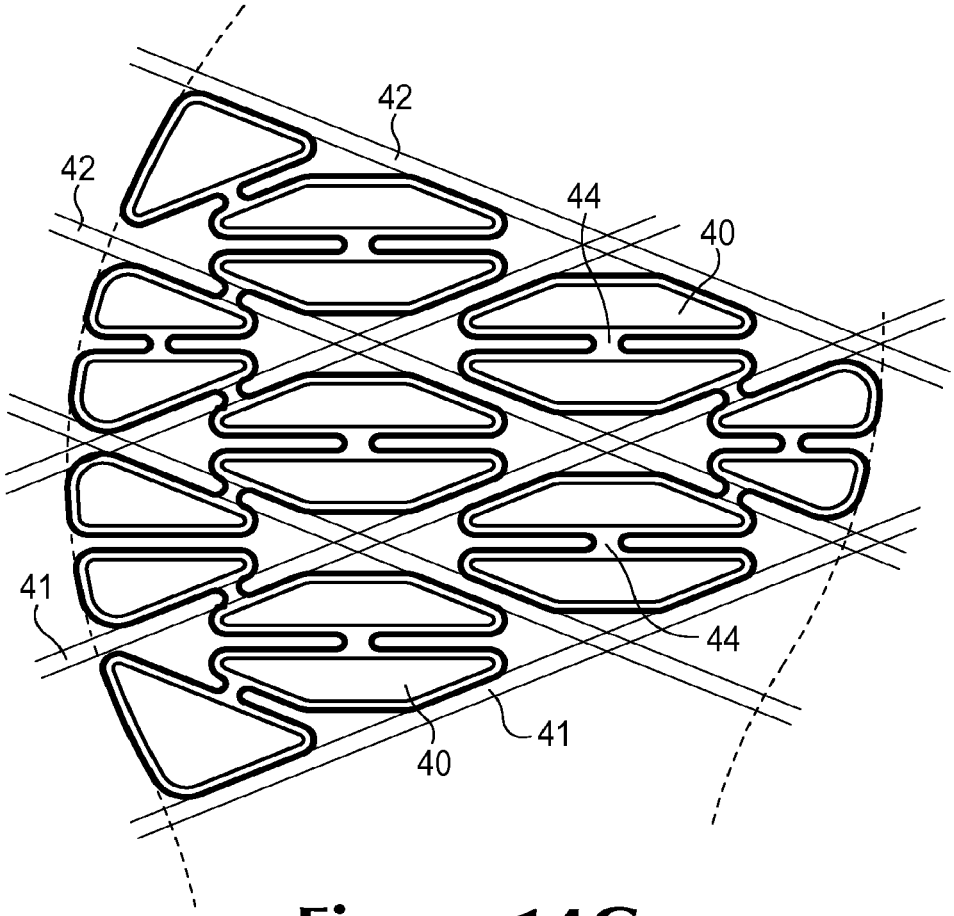
Figure 14H:
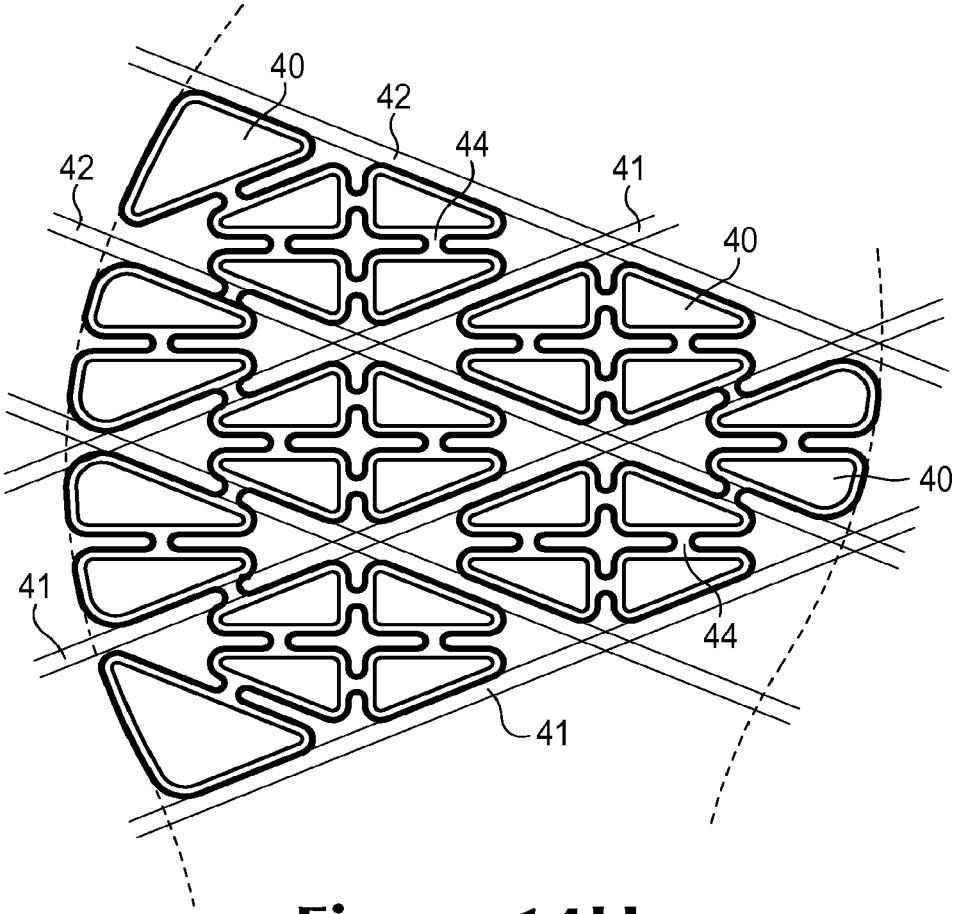

In the initial configuration, each of a centrally-located and inwardly-spaced portion of chambers 40 is entirely bounded by bounding regions 41 and 42. Accordingly, a majority of a perimeter of each chamber 40 is bounded by bounding regions 41 and 42. In further configurations, each of the centrally-located and inwardly-spaced chambers 40 may be bounded on fewer than all sides by bounding regions 41 and 42. In turn, in such configurations, less than a majority of a perimeter of each chamber 40 might be bounded by bounding regions 41 and 42. For example, with reference to FIG. 14F, centrally-located and inwardly-spaced chambers 40 may have a configuration of sets of two triangles positioned between bounding regions 41 and 42. Alternatively, with reference to FIG. 14G, centrally-located and inwardly-spaced chambers 40 may have a configuration of sets of two trapezoids positioned between bounding regions 41 and 42. In another example, with reference to FIG. 14H, centrally-located and inwardly-spaced chambers 40 may have a configuration of sets of four triangles positioned between bounding regions 41 and 42.

In the initial configuration, a majority of the perimeter of each chamber 40 abuts or is immediately adjacent to substantially linear bounding regions 41 and 42. In other configurations, less than a majority of the perimeter of each chamber 40 abuts or is immediately adjacent to bounding regions 41 and 42. For example, with reference to FIG. 14H, less than a majority of each chamber 40 abuts or is immediately adjacent to bounding regions 41 and 42. Alternatively, with reference to FIG. 14E, each centrally-located and inwardly-spaced chamber 40 abuts or is immediately adjacent to bounding regions 41 and 42 at a plurality of locations comprising less than a majority of the perimeter of each centrally-located and inwardly-spaced chamber 40.

Figure 14I:
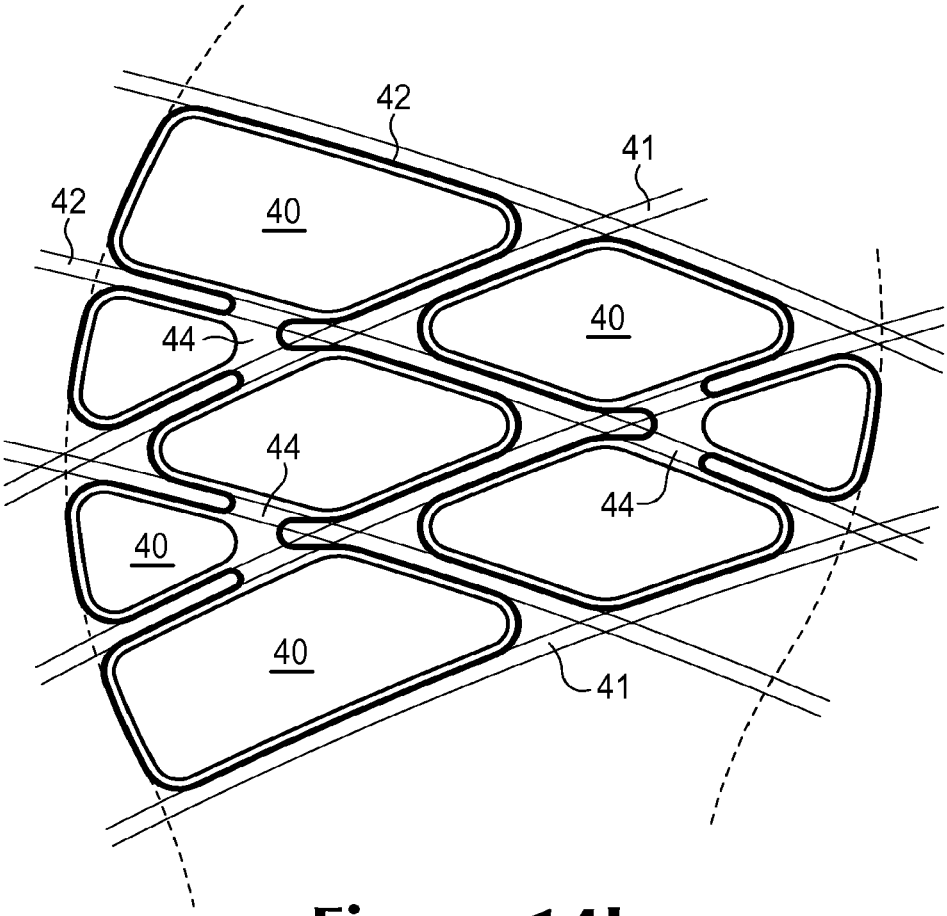
Figure 14J:
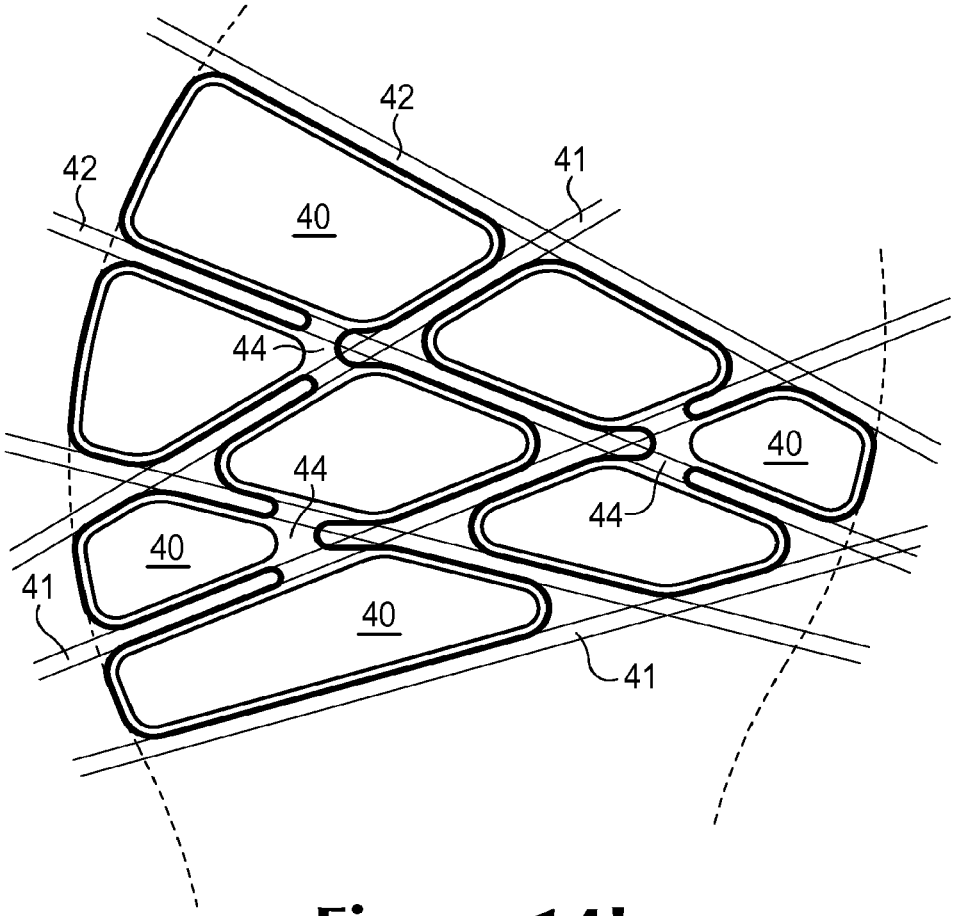
Figure 14K:
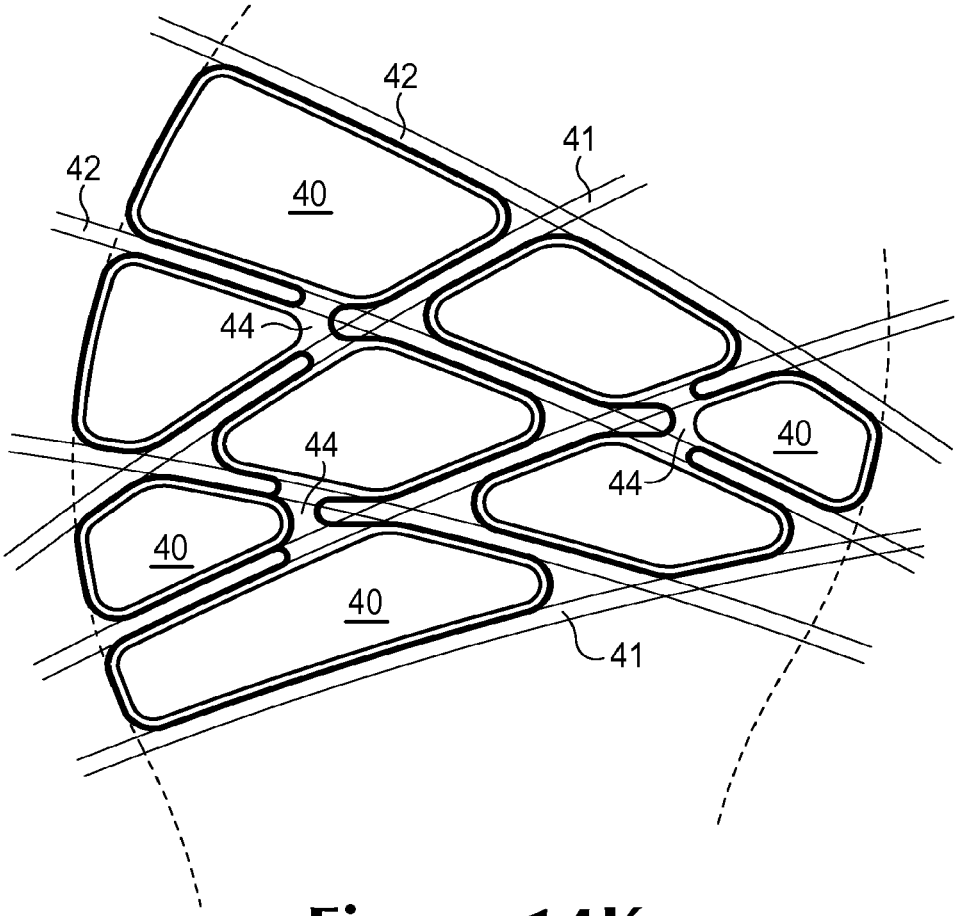

In the initial configuration, first bounding regions 41 are substantially straight and parallel with each other, and second bounding regions 42 are substantially straight and parallel with each other. In other configurations, either or both of first bounding regions 41 or second bounding regions 42 may not be substantially straight or may not be substantially parallel with each other. For example, with reference to FIG. 14I, first bounding regions 41 are substantially curvilinear and parallel with each other, and second bounding regions 42 are substantially curvilinear and parallel with each other. Alternatively, with reference to FIG. 14J, first bounding regions 41 are substantially straight, but are not parallel with each other, and have a configuration of line portions radiating from and about a point outside of lateral side 14 of footwear 10. Similarly, second bounding regions 42 are substantially straight, but not parallel with each other, and have a configuration of line portions radiating from and about a point outside of medial side 15 of footwear 10. In a further example, with reference to FIG. 14K, bounding regions 41 and 42 are substantially curvilinear, but first bounding regions 41 have a configuration of line portions radiating from and about a point outside of lateral side 14, and second bounding regions 42 have a configuration of line portions radiating from and about a point outside of medial side 15.

Figure 14L:
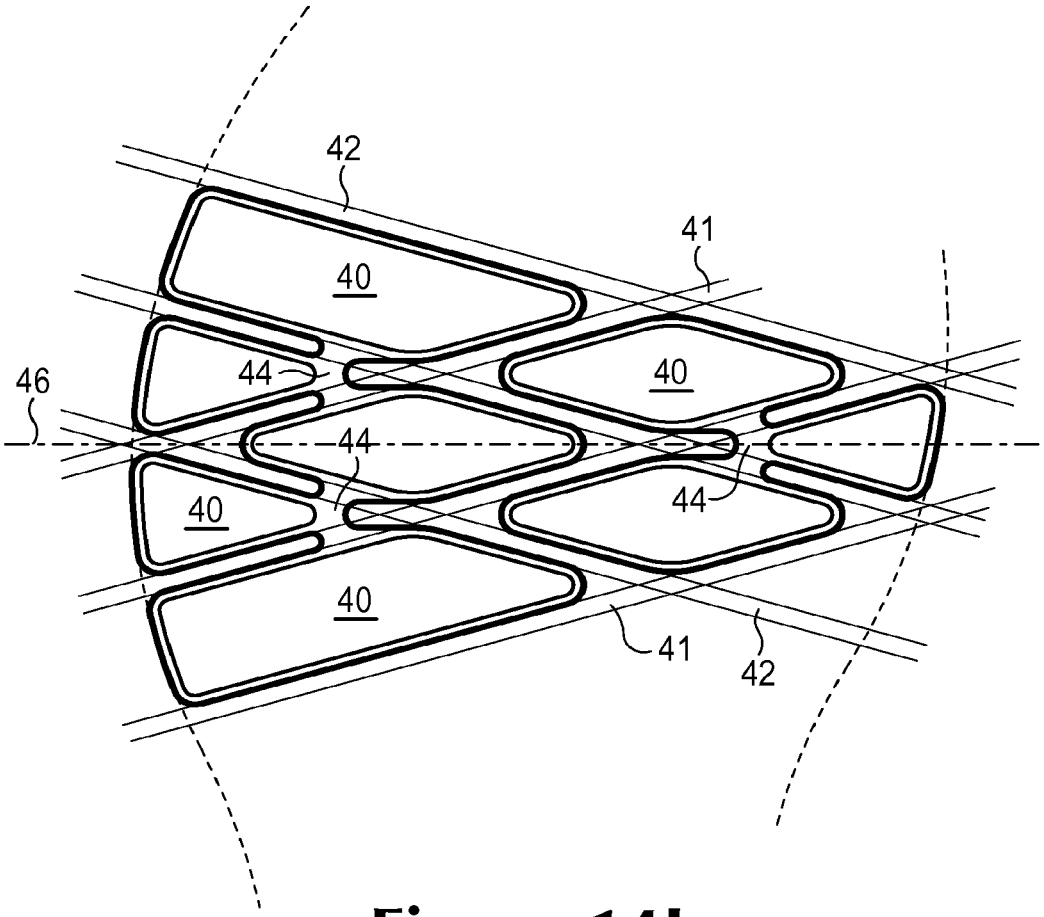
Figure 14M:
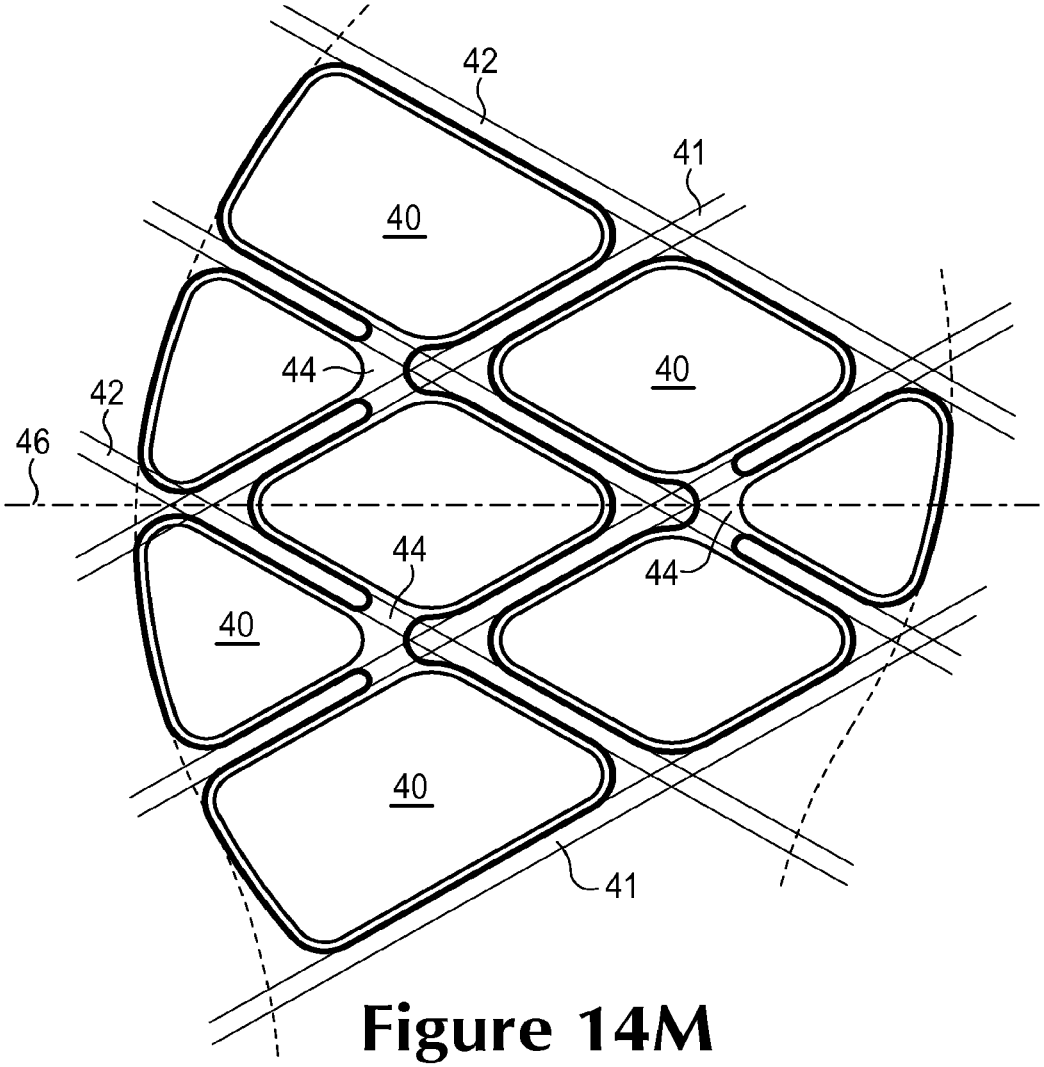
Figure 14N:
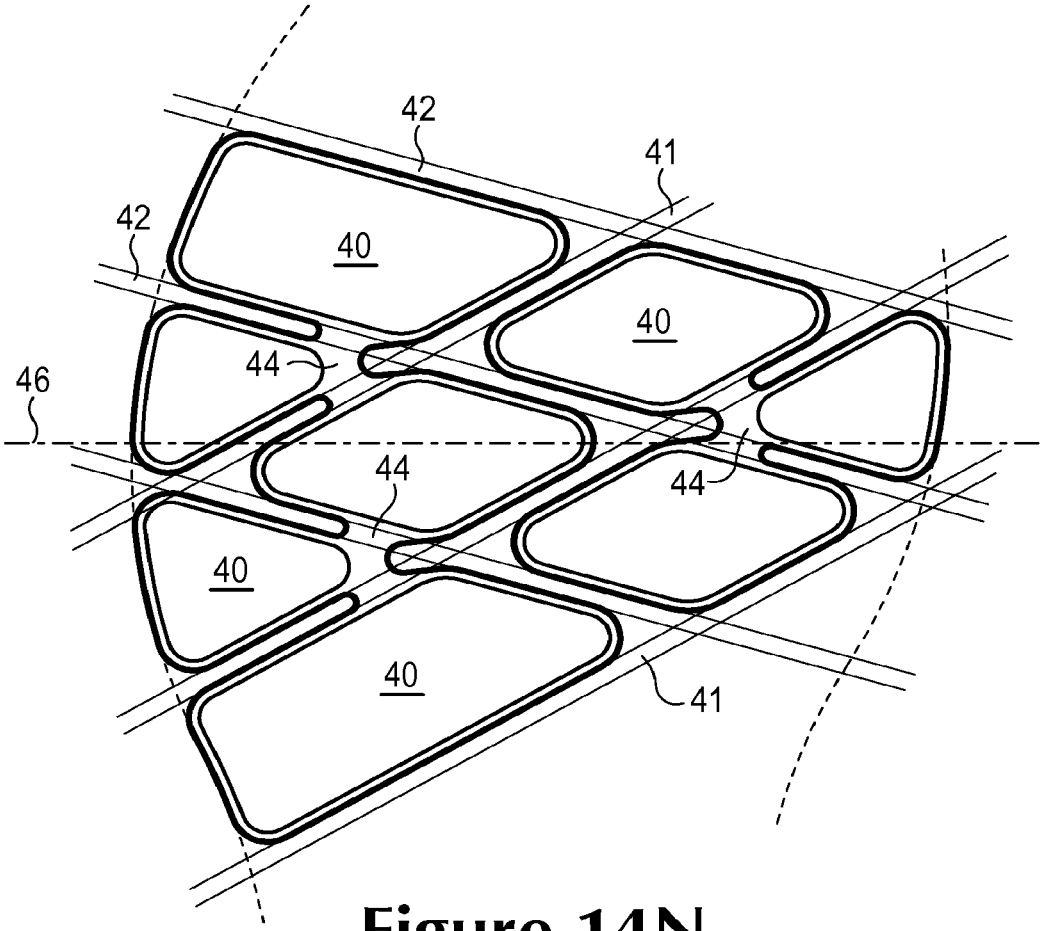

In the initial configuration, first bounding regions 41 are oriented at a first angle of about 30 degrees with respect to mediolateral axis 46 of footwear 10, and second bounding regions 42 are oriented at a second angle of about 30 degrees with respect to mediolateral axis 46, such that the total angle between bounding regions 41 and 42 is about 60 degrees. Additionally, bounding regions 41 and 42 are substantially symmetric about mediolateral axis 46. In further configurations, bounding regions 41 and 42 may be oriented differently with respect to mediolateral axis 46. For example, in FIG. 14L, the total angle between bounding regions 41 and 42 is about 40 degrees. Alternatively, in FIG. 14M, the total angle between bounding regions 41 and 42 is about 80 degrees. In a further example, with reference to FIG. 14N, bounding regions 41 and 42 are not substantially symmetric about mediolateral axis 46.

Figure 14O:
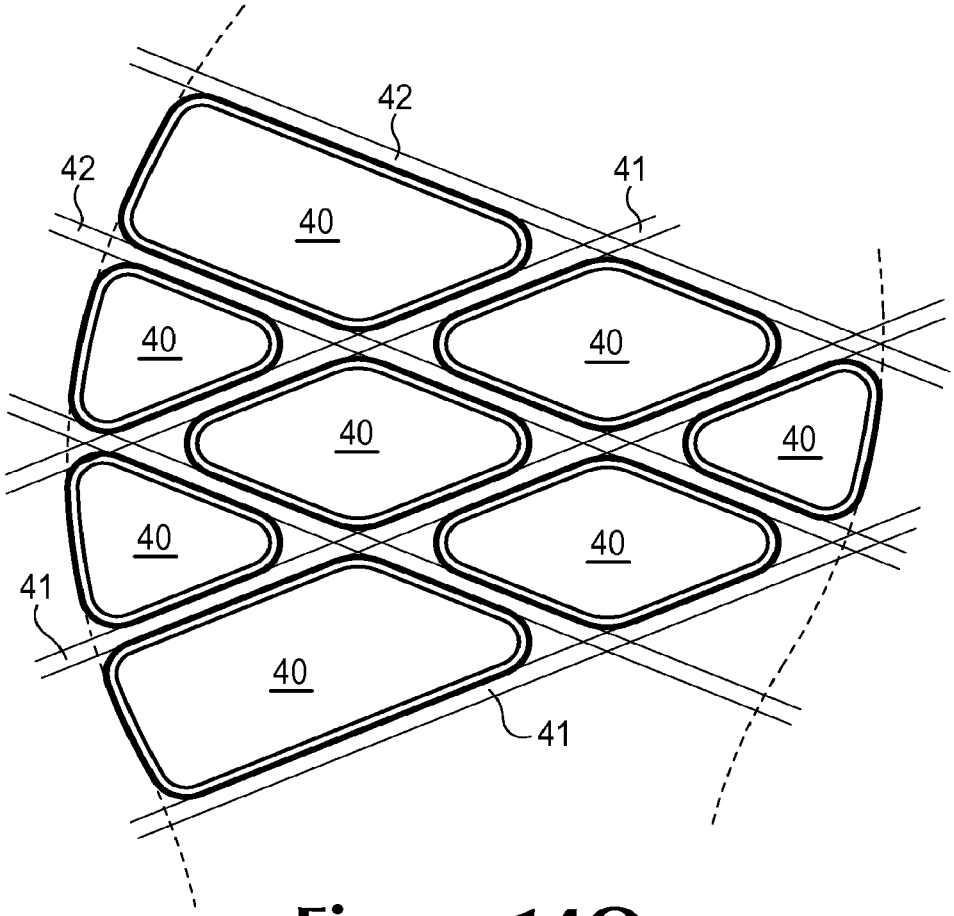
Figure 14P:
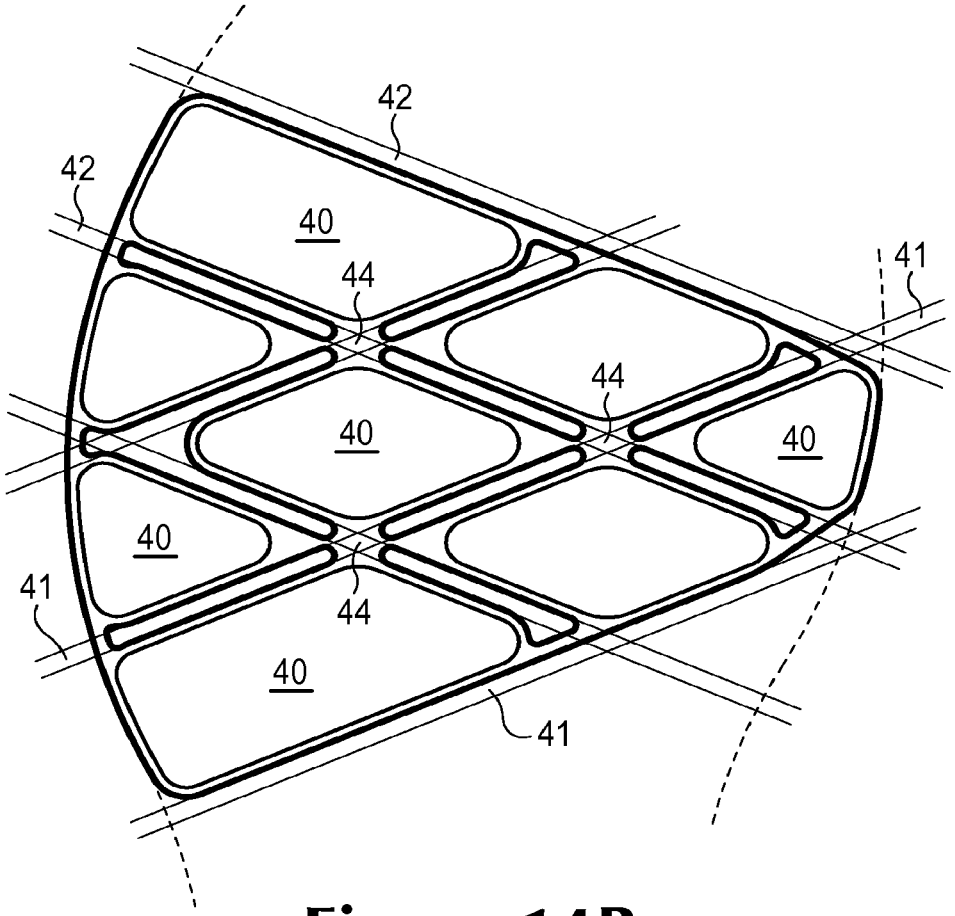

In the initial configuration, chambers 40 are connected to each other by a minimally sufficient number of connections 44. In other configurations, connections 44 may be otherwise connected or even absent. For example, in FIG. 14O, chambers 40 are not connected to each other at all. Alternatively, in FIG. 14P, each of chambers 40 is connected to each of the nearest other chambers 40 at the corners of chambers 40.

Figure 14Q:
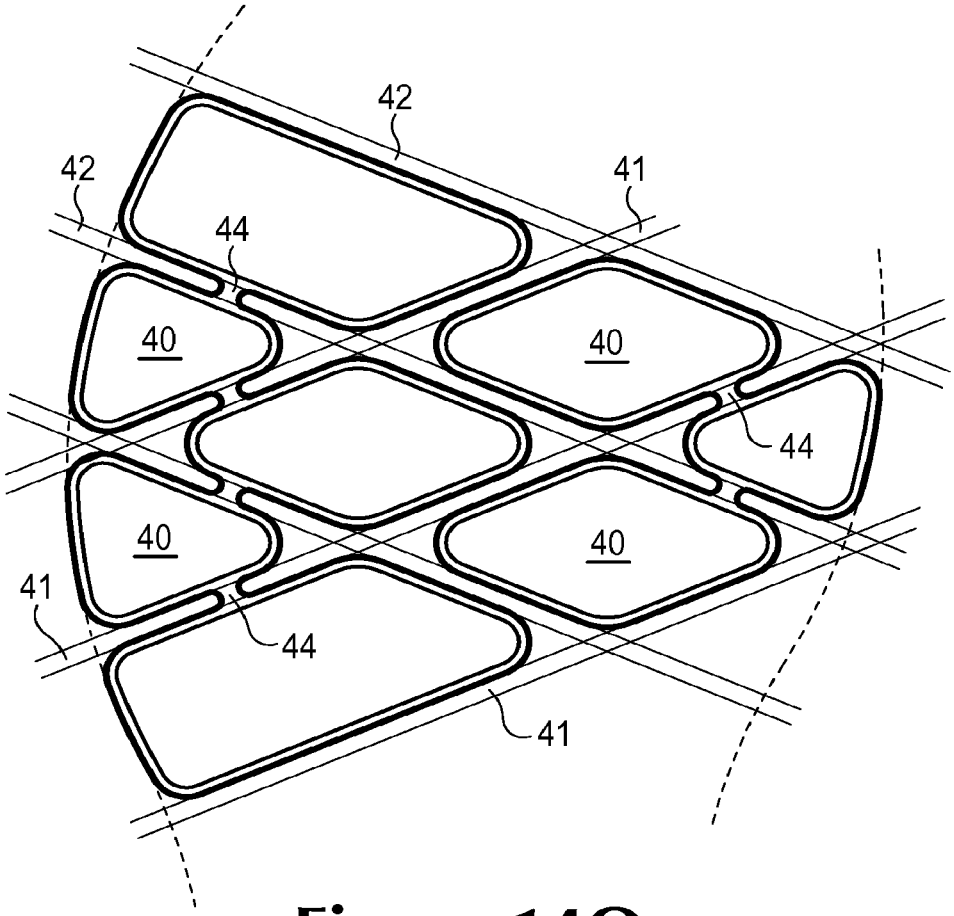

In the initial configuration, chambers 40 are connected to each other by connections 44, each of which is substantially parallel to mediolateral axis 46 of footwear 10. In other configurations, connections 44 may be otherwise oriented. For example, in FIG. 14Q, chambers 40 may be connected to each other by connections 44, each of which is substantially perpendicular to the bounding region 41 or 42 that it crosses.

Figure 15A:
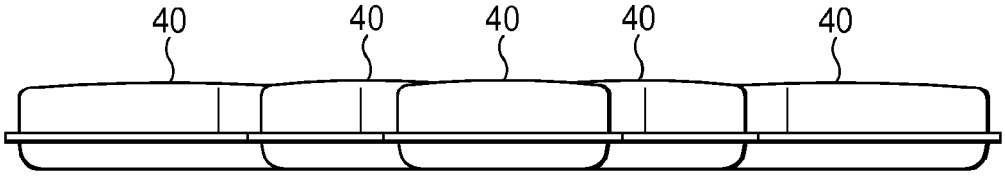
FIGS. 15A-15C are medial side elevational views depicting additional configurations of the chambers, corresponding with FIG. 10.
Figure 15B:
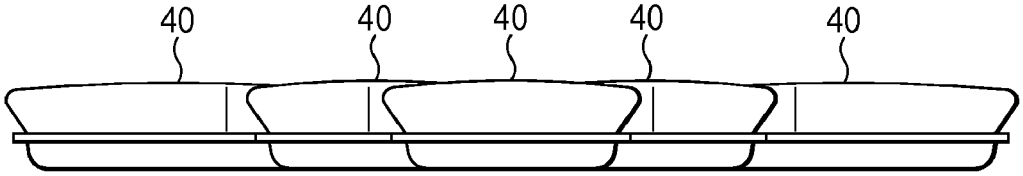
Figure 15C:
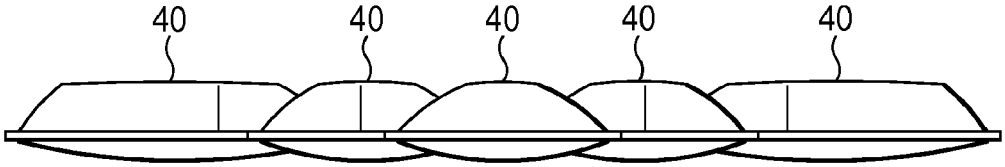

In the initial configuration, a top portion of each of chambers 40 has an inwardly-angled shape, and a bottom portion of each of chambers 40 has a substantially rectangular shape. In other configurations, the top portions and bottom portions of chambers 40 may have any other shape, regular or irregular, or any combination of shapes. For example, in FIG. 15A, a top portion of each of chambers 40 is substantially vertical. Alternatively, in FIG. 15B, a top portion of each of chambers 40 has an outwardly-angled shape. In a further example, in FIG. 15C, a bottom portion of each of chambers 40 has a substantially rounded shape.

The invention is disclosed above and in the accompanying figures with reference to a variety of configurations. The purpose served by the disclosure, however, is to provide an example of various features and concepts related to the invention, not to limit the scope of the invention. One skilled in the relevant art will recognize that numerous variations and modifications may be made to the configurations described above without departing from the scope of the present invention, as defined by the appended claims.

The invention claimed is:

1. A sole structure for an article of footwear including an upper, the sole structure comprising:

a midsole having an upper surface and a lower surface, the upper surface positioned adjacent to the upper and the lower surface defining an array of cavities, each cavity of the array of cavities having tapered interior walls and a perimeter that is coplanar with the lower surface of the midsole;

an outsole secured to the midsole and including a first surface that forms a first portion of a ground-contacting surface of the article of footwear, an array of apertures formed through the first surface and the ground-contacting surface and respectively aligned with one of the array of cavities, and a second surface formed on an opposite side of the outsole than the first surface; and an array of fluid-filled chambers formed separately from both the midsole and the outsole, each fluid-filled chamber in the array of fluid-filled chambers having a shape corresponding to a cavity in the array of cavities and an aperture in the array of apertures, the array of fluid-filled chambers at least partially received within the cavities of the midsole, each of the fluid-filled chambers protruding outward from the cavities through a respective one of the apertures of the outsole, each of the fluid-filled chambers including a second surface that is coplanar with the first surface of the outsole and forms a second portion of the ground-contacting surface of the article of footwear, the fluid-filled chambers joined to one another by a plurality of connections, a first portion of at least one of the plurality of connections being disposed between the outsole and the lower surface of the midsole and contacting the second surface of the outsole and the lower surface of the midsole.

2. The sole structure of claim 1, wherein the chambers form at least part of an edge surface of the sole structure.

3. The sole structure of claim 1, wherein a portion of the at least one of the plurality of connections is visible at an aperture of the array of apertures.

4. The sole structure of claim 1, wherein another of the plurality of connections is visible at an aperture of the array of apertures.

5. The sole structure of claim 1, wherein at least some of the chambers have a shape of a polygon.

6. The sole structure of claim 1, wherein a majority of the chambers are located in a forefoot region of the article of footwear.

7. The sole structure of claim 1, wherein at least some of the plurality of connections are aligned with a mediolateral axis of the article of footwear.

8. The sole structure of claim 1, wherein a second portion of the at least one of the plurality of connections extends from the first portion of the at least one of the plurality of connections, toward a chamber of the array of fluid-filled chambers, and is visible through an aperture of the outsole.

9. A sole structure for an article of footwear including an upper, the sole structure comprising:

a midsole having an upper surface and a lower surface, the upper surface positioned adjacent to the upper and the lower surface defining an array of cavities, each cavity of the array of cavities having tapered interior walls and a perimeter that is coplanar with the lower surface of the midsole;

an outsole including a first surface secured to the midsole, a second surface formed on an opposite side of the outsole than the first surface, and an array of apertures extending through the first surface and the second surface and respectively aligned with one of the array of cavities, each aperture in the array of apertures having a shape that is the same as a shape of a corresponding cavity in the array of cavities, the second surface forming a first portion of a ground-contacting surface of the article of footwear; and an array of fluid-filled chambers each formed separately from both the midsole and the outsole, each fluid-filled chamber in the array of fluid-filled chambers having a shape corresponding to a cavity in the array of cavities and an aperture in the array of apertures, the array of fluid-filled chambers at least partially received within the cavities of the midsole, each of the fluid-filled chambers protruding outward from the cavities through a respective one of the apertures of the outsole, each of the fluid-filled chambers including a second surface that is coplanar with the second surface of the outsole and forms a second portion of the ground-contacting surface of the article of footwear, the fluid-filled chambers joined to one another by a plurality of connections, a first portion of at least one of the plurality of connections being in contact with the first surface of the outsole and the lower surface of the midsole.

10. The sole structure of claim 9, wherein the chambers form at least part of an edge surface of the sole structure.

11. The sole structure of claim 9, wherein a portion of the at least one of the plurality of connections is visible at an aperture of the array of apertures.

12. The sole structure of claim 9, wherein another of the plurality of connections is visible at an aperture of the array of apertures.

13. The sole structure of claim 9, wherein at least some of the chambers have a shape of a polygon.

14. The sole structure of claim 9, wherein a majority of the chambers are located in a forefoot region of the article of footwear.

15. The sole structure of claim 9, wherein at least some of the plurality of connections are aligned with a mediolateral axis of the article of footwear.

16. The sole structure of claim 9, wherein a second portion of the at least one of the plurality of connections extends from the first portion of the at least one of the plurality of connections and to a chamber of the array of fluid-filled chambers.

17. The sole structure of claim 16, wherein the second portion of the at least one of the plurality of connections is visible through an aperture of the outsole.

* * * * *